US007823867B2

(12) United States Patent
Sato et al.

(10) Patent No.: US 7,823,867 B2
(45) Date of Patent: Nov. 2, 2010

(54) SHEET CONVEYING APPARATUS AND BOOK BINDING APPARATUS

(75) Inventors: Mitsuhiko Sato, Kashiwa (JP); Hidenori Sunada, Toride (JP); Naoto Watanabe, Abiko (JP); Takashi Yokoya, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 662 days.

(21) Appl. No.: 11/693,480

(22) Filed: Mar. 29, 2007

(65) Prior Publication Data

US 2007/0228632 A1 Oct. 4, 2007

(30) Foreign Application Priority Data

Mar. 30, 2006 (JP) ..... 2006-094561

(51) Int. Cl.
*B65H 37/04* (2006.01)

(52) U.S. Cl. ..... 270/58.09; 270/58.07; 270/58.08; 270/58.11; 270/58.23

(58) Field of Classification Search ..... 270/32, 270/37, 52.18, 58.07, 58.08, 58.09, 58.11, 270/58.23

See application file for complete search history.

(56) References Cited

U.S. PATENT DOCUMENTS 6,213,456 B1 * 4/2001 Hirano et al. ..... 270/58.08
6,435,331 B1 * 8/2002 Olson et al. ..... 198/357
6,717,286 B2 * 4/2004 Tsuchiya et al. ..... 270/58.07
7,261,507 B2 * 8/2007 Horii et al. ..... 412/35
7,263,328 B2 * 8/2007 Asai et al. ..... 399/408
7,413,176 B2 * 8/2008 Hirata et al. ..... 270/58.08
2005/0232656 A1 * 10/2005 Asai et al. ..... 399/130
2007/0045920 A1 * 3/2007 Yoshie et al. ..... 270/37
2007/0085256 A1 * 4/2007 Miyake et al. ..... 270/52.18

FOREIGN PATENT DOCUMENTS

JP 62-056233 3/1987
JP 2005-335909 A 12/2005

* cited by examiner

*Primary Examiner*—Leslie A Nicholson, III
(74) *Attorney, Agent, or Firm*—Canon USA Inc IP Div.

(57) ABSTRACT

A sheet conveying apparatus includes first and second conveying paths. The first conveying path is configured to receive a sheet from a device connected at an upstream side in a sheet conveying direction so as to transfer the sheet to a device connected at a downstream side in the sheet conveying direction. The second conveying path intersects with the first conveying path. A controller switches between a first operation mode and a second operation mode. In the first operation mode, the sheet is conveyed along the first conveying path, and in the second operation mode, the sheet is conveyed along the second conveying path. The controller controls a sheet conveying operation in the first operation mode or the second operation mode in accordance with the state of the sheet on the second conveying path.

7 Claims, 35 Drawing Sheets

SHEET CONVEYING APPARATUS AND BOOK BINDING APPARATUS

BACKGROUND OF THE INVENTION

1. Field of the Invention

The present invention relates to a sheet conveying apparatus for conveying a plurality of sheets, and a book binding apparatus for book binding a sheet bundle including a plurality of sheets.

2. Description of the Related Art

Recently, image forming apparatuses of the electrophotographic and inkjet type have been improved in speed and image quality, so that such an inkjet or electrophotographic image forming apparatus becomes able to produce a printed matter that a large-sized printing press has only been able to make.

The large-sized printing press only prints images on sheets, and after treatment, such as stapling and book binding, employs a different special purpose machine. Also, the large-sized printing press is suitable for printing a large number of printed matters in view of cost and plate making time.

Whereas, the inkjet or electrophotographic image forming apparatus can connect a plurality of after treatment machines thereto, so that it is advantageous to be able to carry through the process from the printing to the after processing with one apparatus. The inkjet or electrophotographic image forming apparatus is also suitable for printing the small number of printed matters in comparison with the large-sized printing press.

On the other hand, a configuration of a book binding apparatus arranged between an image forming apparatus and an after treatment device is disclosed in Japanese Patent Laid-Open No. 2005-335909. In this configuration, when a sheet outputted from the image forming apparatus is conveyed through to the after treatment device, the book binding apparatus receives the sheet from the image forming apparatus arranged upstream in the conveying direction so as to transfer the sheet to the after treatment device on the downstream side.

The book binding apparatus disclosed in Japanese Patent Laid-Open No. 2005-335909 includes a conveying path used during book binding and another conveying path intersecting with the conveying path for transferring a sheet to the after treatment device so as to achieve the miniaturization and the space saving.

However, during the book binding in the book binding apparatus or during conveying the book bound sheet bundle onto a sheet loading tray, the sheet may not be conveyed to the after treatment device on the downstream side because of the intersection of the conveying paths. That is, when the job transferring the sheet to the after treatment device is executed in succession to the book binding job in the book binding apparatus, the sheet bundle bound by the book binding apparatus may collide on a sheet to be conveyed to the after treatment device on the downstream side so as to generate sheet jamming. For solving this problem, the job transferring the sheet to the after treatment device may be waited until the book binding processing is completely finished. However the productivity may be deteriorated.

SUMMARY OF THE INVENTION

The present invention is directed to a sheet conveying apparatus and a book binding apparatus capable of improving productivity by preventing problems, such as sheet jamming, even in a compact book binding apparatus in which conveying paths intersect with each other.

A sheet conveying apparatus according to an aspect of the present invention includes a first conveying path configured to receive a sheet from a first device connected at an upstream side in a sheet conveying direction so as to facilitate transferring the sheet to a second device connected at a downstream side in the sheet conveying direction; a second conveying path intersecting with the first conveying path; and a controller configured to switch between a first operation mode in which the sheet is conveyed along the first conveying path and a second operation mode in which the sheet is conveyed along the second conveying path. The controller controls a sheet conveying operation to operate in the first operation mode or the second operation mode in accordance with a state of the sheet on the second conveying path.

A book binding apparatus according to another aspect of the present invention includes a first conveying path configured to receive a sheet from a first device connected at an upstream side in a sheet conveying direction so as to facilitate transferring the sheet to a second device connected at a downstream side in the sheet conveying direction; a loading tray configured to receive a plurality of sheets from the first device and to load the sheets thereon to form a sheet bundle; a book binding device configured to convey the sheet bundle loaded on the loading tray and to bind the conveyed sheet bundle; a storing device configured to store the sheet bundle bound by the book binding device therein; a second conveying path configured to facilitate conveying the sheet bundle from the loading tray to the storing device, the second conveying path intersecting with the first conveying path; and a controller configured to switch between a first operation mode in which the sheet is conveyed along the first conveying path so as to transfer the sheet to the second device, and a second operation mode in which the sheet bundle is conveyed along the second conveying path so as to execute binding on the sheet bundle using the book binding device. The controller controls a sheet conveying operation in the first operation mode or the second operation mode in accordance with a state of the sheet on the second conveying path.

Further features of the present invention will become apparent from the following description of exemplary embodiments with reference to the attached drawings.

DESCRIPTION OF THE EMBODIMENTS (Overall Configuration)

Figure 1:
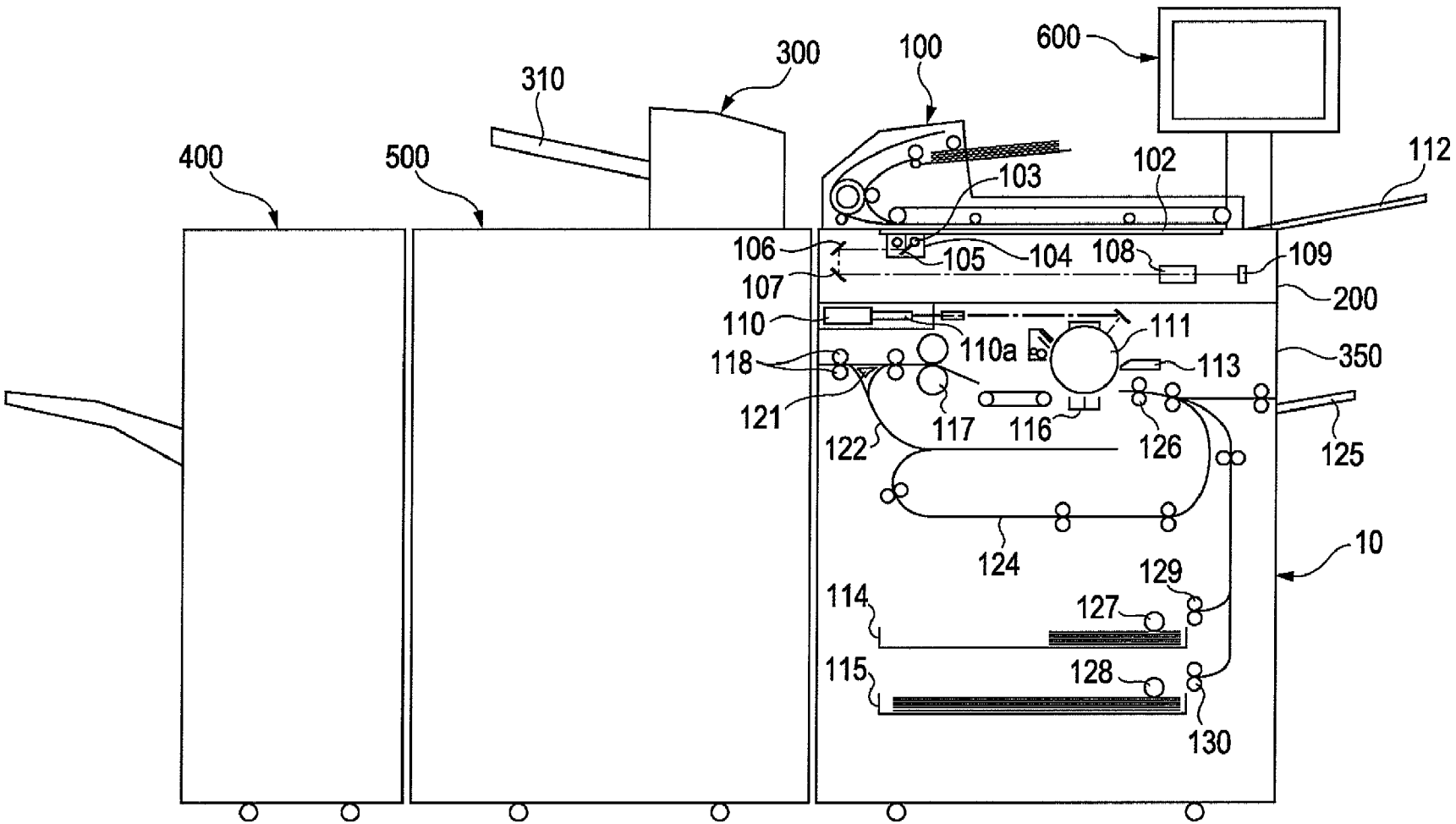
FIG. 1 is a drawing of an entire configuration of an image forming system.

FIG. 1 shows a sectional structure of an essential part of an image forming apparatus. The image forming apparatus, as shown in FIG. 1, includes an image forming apparatus body 10, a bonding book binding apparatus 500, and an after treatment device 400. The image forming apparatus body 10 includes an image reader 200 for reading images from a document and a printer 350 for forming images on a sheet based on the read images.

Upon describing the configuration of each component in detail, on the image reader 200 of the image forming apparatus body 10, a document feeding device 100 is mounted. The document feeding device 100 sequentially feeds one document at a time in the left direction in FIG. 1 from a top page of documents set on a document tray in an upward position so as to make the document flow over a platen glass 102 via a curved path from the left, where the document is conveyed to the right over a reading position, and then discharged onto a discharge tray 112 at the outside. When the document passes over the moving document reading position on the platen glass 102 from the left to right, document images are read by a scanner unit 104 held at a position corresponding to that of the moving document reading position. This is generally called as a moving document reading method. Specifically, during passing of the document over the moving document reading position, the reading surface of the document is irradiated with light from a lamp 103 of the scanner unit 104 so that the reflected light from the document is directed to a lens 108 via mirrors 105, 106, and 107. The light having passed through the lens 108 focuses on the imaging surface of an image sensor 109.

By conveying the document so as to pass the document through the moving document reading position from the left to right, in such a manner, the document is scanned for reading in that the principal scanning direction is perpendicular to the document conveying direction and the secondary scanning direction is that of the document conveying. That is, when the document passes through the moving document reading position, while document images being read every one line in the principal scanning direction, the document is conveyed in the secondary scanning direction so as to read the entire document images. The optically read images are converted into image data by the image sensor 109 for outputting. The image data outputted from the image sensor 109 enter an exposure control unit 110 of the printer 350 as video signals.

The document may also be conveyed onto the platen glass 102 by the document feeding device 100 to stop at a predetermined position for being scanned with the scanner unit 104 from the left to right to read the document images in the stopped state. This is a so-called fixed document reading method.

When a document is read without using the document feeding device 100, a user first places the document on the platen glass 102 by lifting the document feeding device 100, and the document is read by scanning the document with the scanner unit 104 from the left to right. That is, when the document is read without using the document feeding device 100, the fixed document reading method is employed.

The exposure control unit 110 of the printer 350 modulates laser light for outputting on the basis of the video signals inputted from the image reader 200. The laser light irradiates a photosensitive drum 111 while a polygon mirror 110*a* is scanned with the laser light. On the photosensitive drum 111, electrostatic latent images are formed corresponding to the laser light. The exposure control unit 110 herein produces laser light to form normal images (not mirror images) during the fixed document reading. The electrostatic latent images on the photosensitive drum 111 are visualized as developed images by developer supplied from a developing unit 113.

On the other hand, a sheet supplied from an upper cassette 114 or a lower cassette 115 by pickup rollers 127 and 128 is conveyed to registration rollers 126 by feed rollers 129 and 130. When the leading end of the sheet arrives at the registration roller 126, the sheet is conveyed to a point between the photosensitive drum 111 and a transfer unit 116 simultaneously with the irradiation start of the laser light by driving the registration rollers 126 at an arbitrary time. The developer images formed on the photosensitive drum 111 are transferred on a supplied sheet by the transfer unit 116. The sheet having the developer images transferred thereon is conveyed to a fixing unit 117 so as to fix the developer images on the sheet by pressurizing and heating the sheet with the fixing unit 117. The sheet having passed through the fixing unit 117 is discharged from the printer 350 toward the outside of the image forming apparatus body (a bonding book binding apparatus 500) via a flapper 121 and discharge rollers 118.

When the sheet is discharged in a state of the image forming surface facing downward (face-down state), the sheet having passed through the fixing unit 117 is once led into an inversion path 122 by switching the flapper 121. Then, after the trailing end of the sheet passes through the flapper 121, the sheet is switched back and discharged from the printer 350 by the discharge rollers 118. This is called as inversion discharging. The inversion discharging is employed when images are sequentially formed from the top page, like in forming images read using the document feeding device 100 or in forming images outputted from a computer, to have precise page order discharged sheets.

From a manual feed unit 125, a hard sheet, such as an OHP sheet, is fed, and when images are formed on this sheet, the sheet is discharged in a state of the image forming surface facing upward (face-up state) by the discharge rollers 118 without leading the sheet to the inversion path 122. Furthermore, when the double-sided recording is set for forming images on both sides of a sheet, after the sheet is led to the inversion path 122 by switching the flapper 121, the sheet is conveyed to a double-sided conveying path 124. The sheet led to the double-sided conveying path 124 is again fed to the point between the photosensitive drum 111 and the transfer unit 116 at the time mentioned above. The sheet discharged from the printer 350 of the image forming apparatus body 10 is conveyed to the bonding book binding apparatus 500.

(Bonding Book Binding Apparatus)

Figure 2:
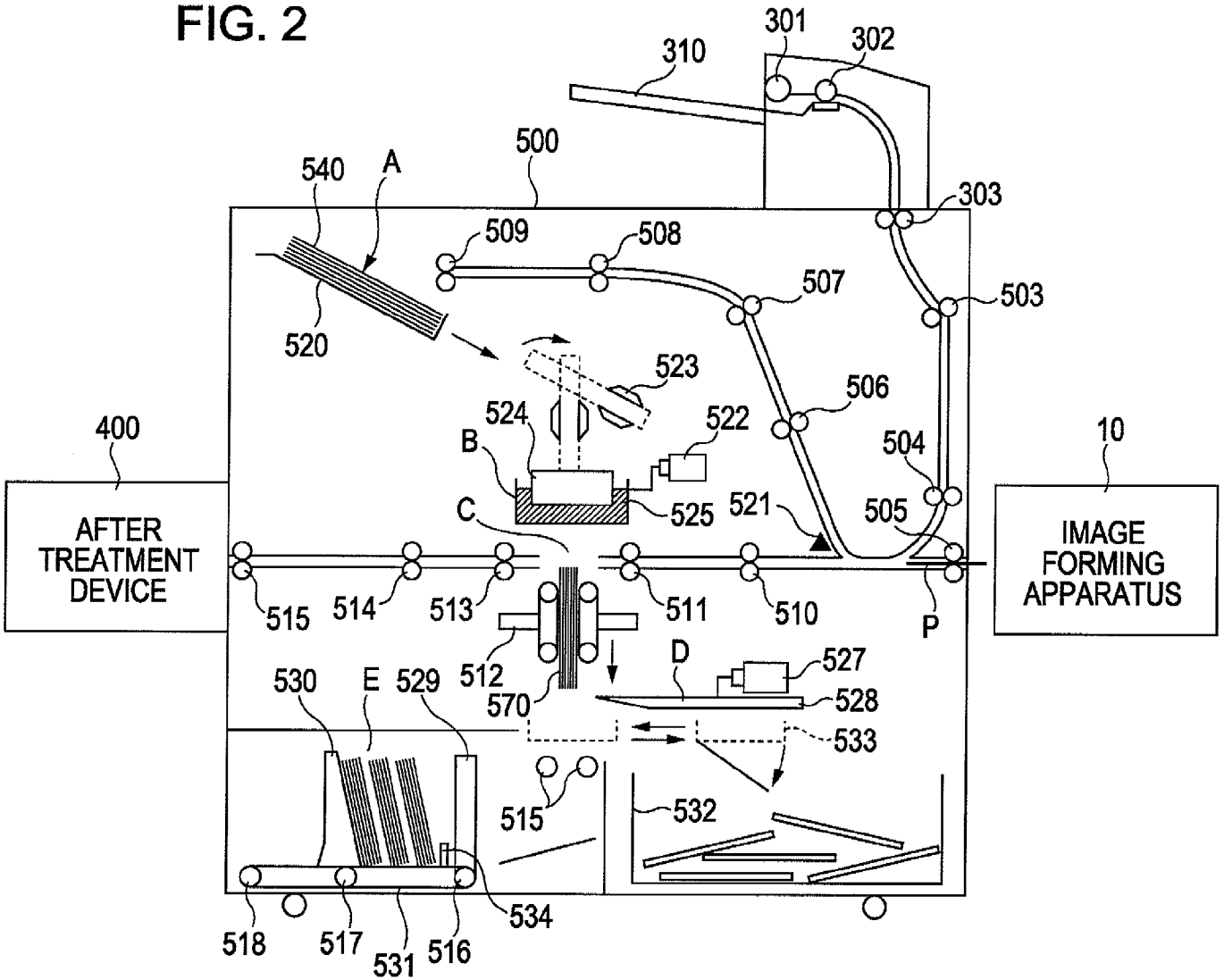
FIG. 2 is a sectional view of an entire bonding book binding apparatus.

FIG. 2 is a sectional view of the internal configuration of the bonding book binding apparatus 500 according to the present invention. The bonding book binding apparatus 500 includes a sheet loading unit A loading the recording sheets discharged from the image forming apparatus in a book binding mode for forming a sheet bundle, a gluing unit B for gluing the loaded sheet bundle, a bonding unit C for bonding the glued sheet bundle on a book cover, a cutting unit D cutting three sides other than the bonding side for aligning the side edges of the bound book, and a bound book discharge unit E for discharging and storing the bound books.

Next, a series of book binding flow will be described. In addition, the description is brought to a stop within a schema at this time and the detail of each process will be described later. The sheet loading unit A is for forming a sheet bundle 540 by loading the recording sheet discharged from the image forming apparatus onto a loading tray 520. The sheet bundle 540 formed by the sheet loading unit A is moved to the gluing unit B so that glue is applied to the lower side of a sheet bundle by a glue container 525, a glue applying roller 524, and a glue applying roller control motor 522.

The bonding unit C bonds the glued sheet bundle 540 on a book cover P discharged from the image forming apparatus body 10 for making a booklet 570 so as to transfer it to a trim gripper 512. The booklet 570 is conveyed to the cutting unit D by the trim gripper 512. In the cutting unit D, the booklet 570 is cut by horizontally moving a cutter 528 with a cutter control motor 527. The cutting scraps drop into a scrap receiving box 533 so as to be recovered within the scrap receiving box 533, completing the cutting operation. The booklet 570 cut by the cutting unit D is conveyed to the bound book discharge unit E for being discharged. The above flow is a series of book binding operations in the book binding mode. However, in addition to the book binding mode, a normal discharge mode without the book binding can also be selected.

A switching flapper 521 is arranged downstream a conveying roller pair 505. The switching flapper 521 selectively guides the sheet conveyed by the conveying roller pair 505 toward either the sheet loading tray 520 or an after treatment device 400.

A sheet P discharged from the image forming apparatus 10 in the normal mode, is conveyed to the after treatment device 400 by conveying roller pairs 505, 510, 511, 513, and 514 and discharge rollers 515. The after treatment device includes a sheet after treatment device, such as a finisher, which is connected to the book binding apparatus as a downstream device for performing sheet bundle after treatment, such as sheet bundle discharging, binding, folding, and book binding.

The sheet P discharged from the image forming apparatus 10 in the book binding mode is conveyed to the above-mentioned sheet loading tray 520 by conveying roller pairs 506, 507, and 508 and a discharge roller pair 509 to form the aligned sheet bundle 540.

(Sheet Flow)

Figure 23:
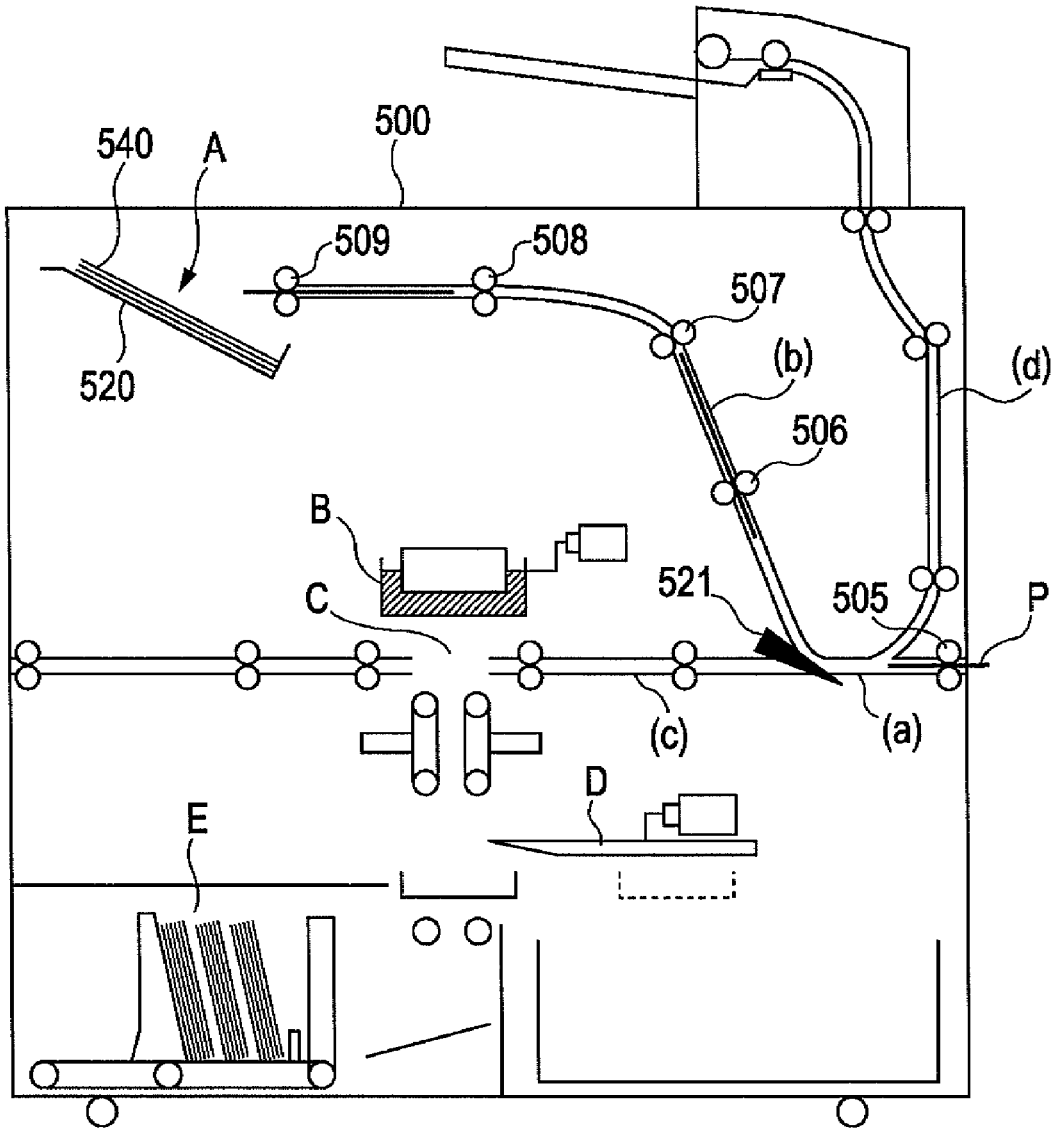
FIGS. 23 and 24 are exemplary views illustrating sheet flow during loading text sheets.
Figure 24:
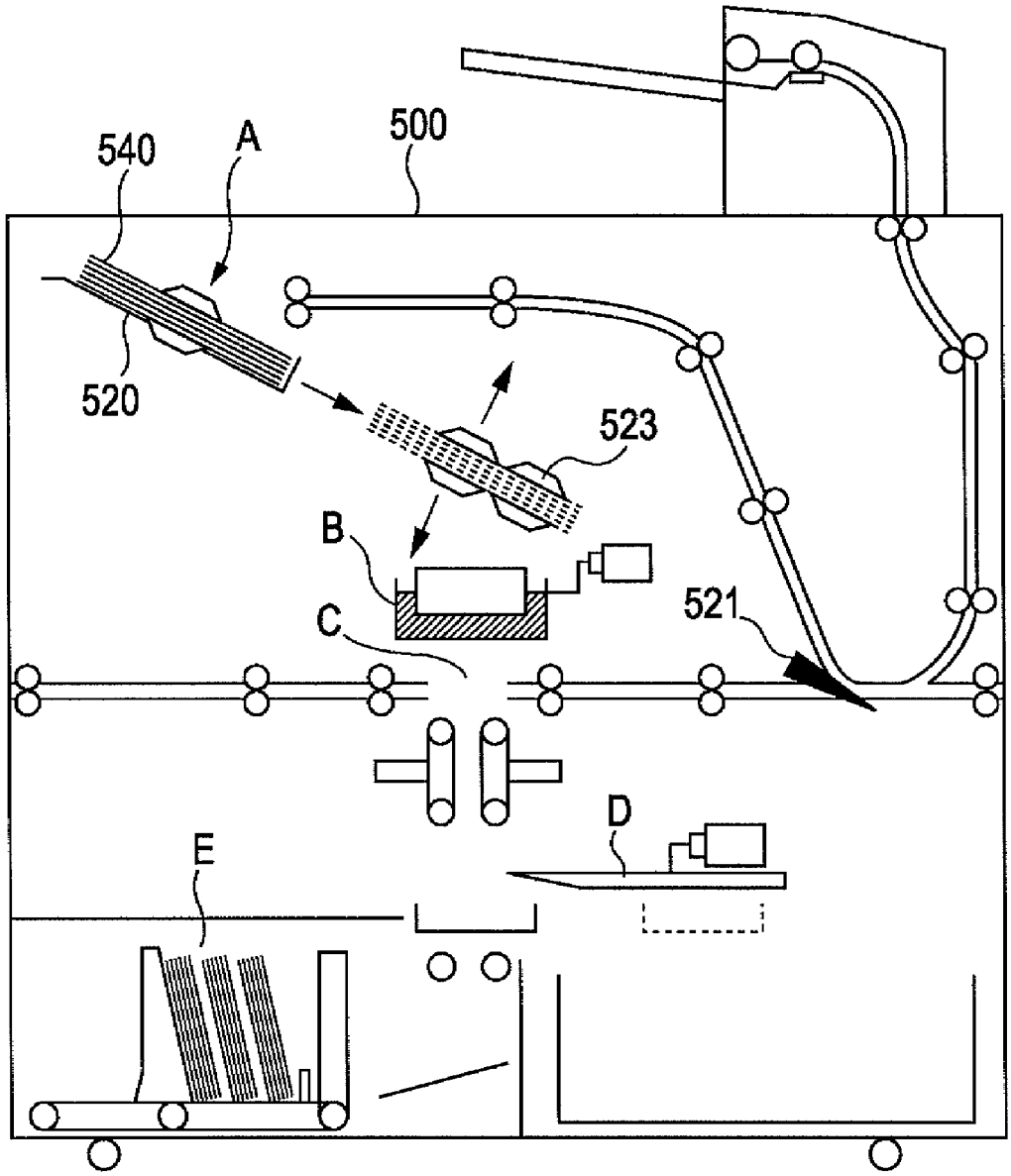

Then, the sheet flow in the bonding book binding apparatus 500 will be described with reference to FIGS. 23 to 26. As shown in FIG. 23, a sheet discharged from the image forming apparatus 10 is taken into the bonding book binding apparatus 500 by the conveying roller pair 505, and is led to a conveying path (a). If the sheet is a text sheet of a sheet bundle, the sheet taken by the conveying roller pair 505 is led to a conveying path (b) by the switching flapper 521 and conveyed by the conveying roller pairs 506, 507, 508, and 509. The sheet P is discharged onto the sheet loading tray 520 by the conveying roller pair 509. When the entire text sheets are discharged onto the sheet loading tray 520, the sheet bundle 540 composed of the text sheets gripped by a gluing gripper 523, as shown in dotted lines in FIG. 24, is moved from the sheet loading unit A to above the gluing unit B in a bundle state.

Figure 25:
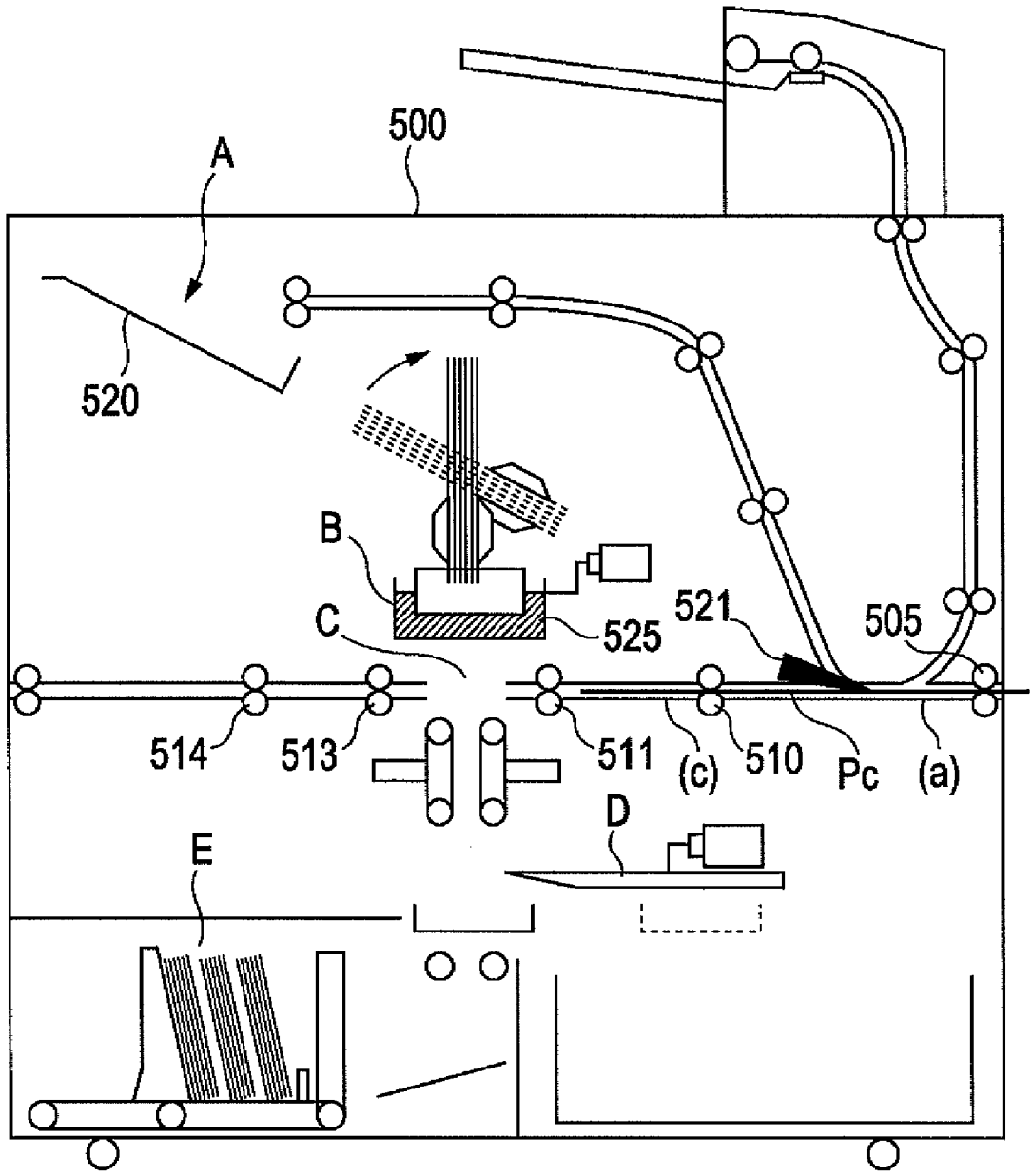
FIGS. 25 and 26 are exemplary views illustrating text sheet and book cover flow.
Figure 26:
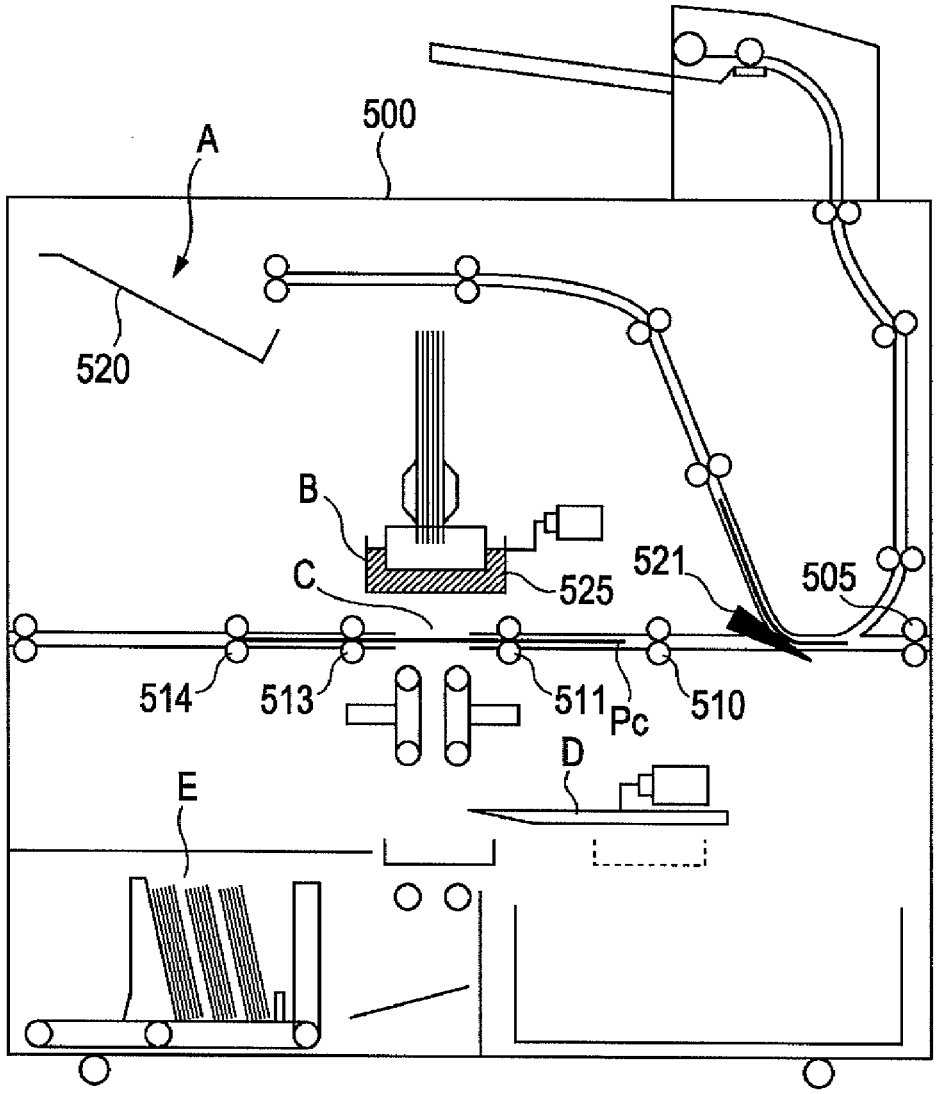

When the bundle of the text sheets moved above the gluing unit B is griped by the gluing gripper 523 so as to be rotated to a vertical direction, as shown in FIG. 25, a side of the sheet bundle to be a spine is positioned to oppose the gluing unit B. Then, although the detail will be described below, the glue container 525 and the glue applying roller 524 are moved along the sheet bundle, so that the side of the sheet bundle is glued. Meanwhile, a book cover Pc is discharged from the image forming apparatus 10 and is conveyed to the bonding book binding apparatus 500. The book cover Pc taken in by the conveying roller pair 505 is guided from the conveying path (a) to the conveying path (c) by the switching of the switching flapper 521, and is conveyed by the conveying roller pairs 510, 511, 513, and 514. Along the conveying path (c), a sensor (not shown) is arranged downstream the conveying roller pair 513 for detecting the leading end of the book cover Pc. After the detection, as shown in FIG. 26, the book cover Pc is conveyed by a predetermined distance, and is stopped.

At the time when the book cover Pc stops in the conveying path (c), it is configured that the trailing end of the book cover Pc escapes from the switching flapper 521. When the book cover Pc is continuously formed, even the book cover is existing within the conveying path (c), a text sheet for the next sheet bundle is received from the image forming apparatus 10 by switching the switching flapper 521 so as to convey the text sheet from the conveying path (a) onto the sheet loading tray 520 via the conveying path (b). Thereafter, the glued sheet bundle is bonded with the book cover Pc, and is conveyed downstream. The detail control of this operation will be described below. The conveyance of the book cover Pc from the image forming apparatus 10 has been described as above. Alternatively, above the bonding book binding apparatus 500, an inserter 300 is provided, so that only the book cover may be inserted from the inserter 300.

Figure 27:
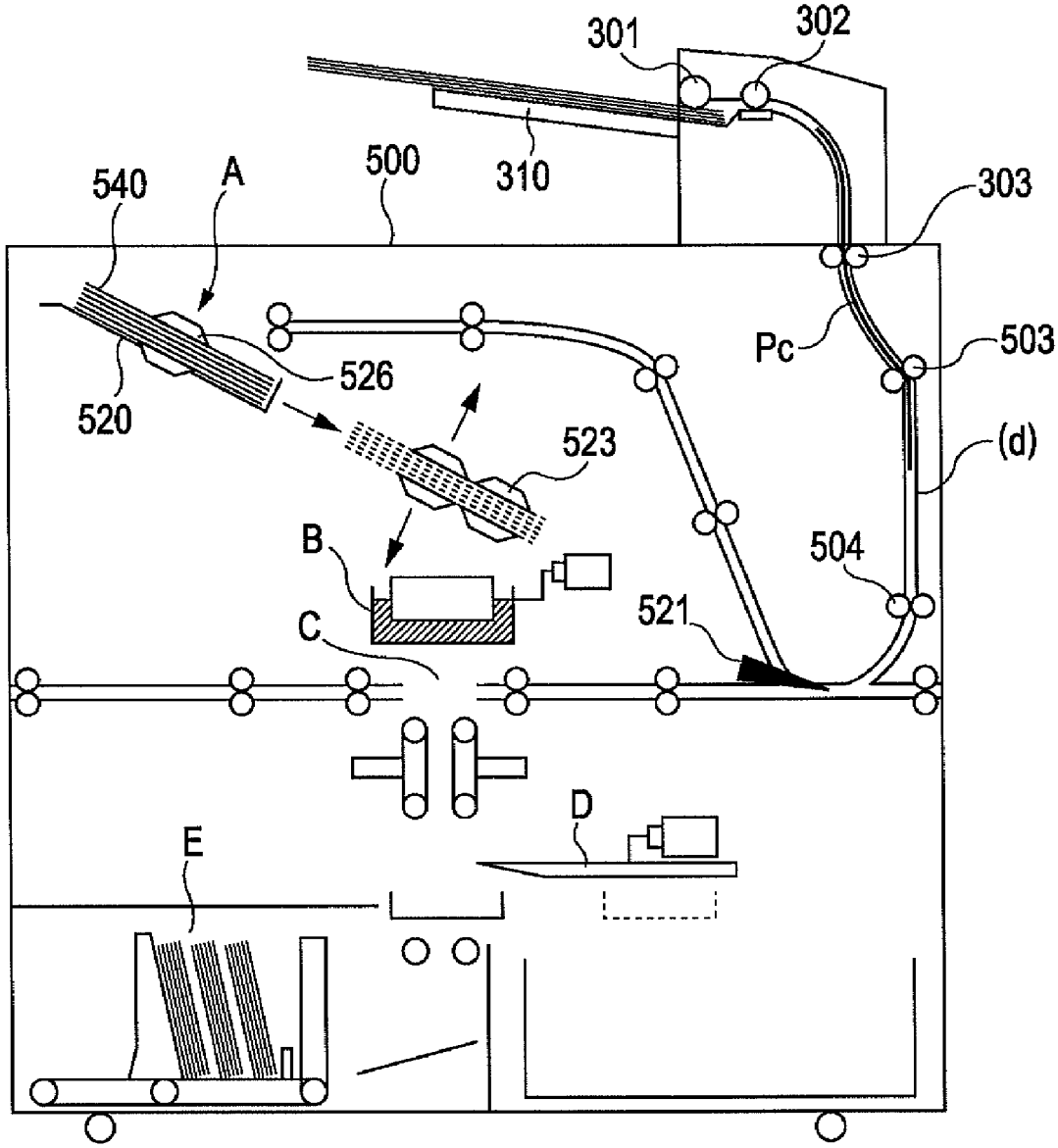
FIGS. 27 and 28 are exemplary views illustrating book cover flow fed from an inserter.
Figure 28:
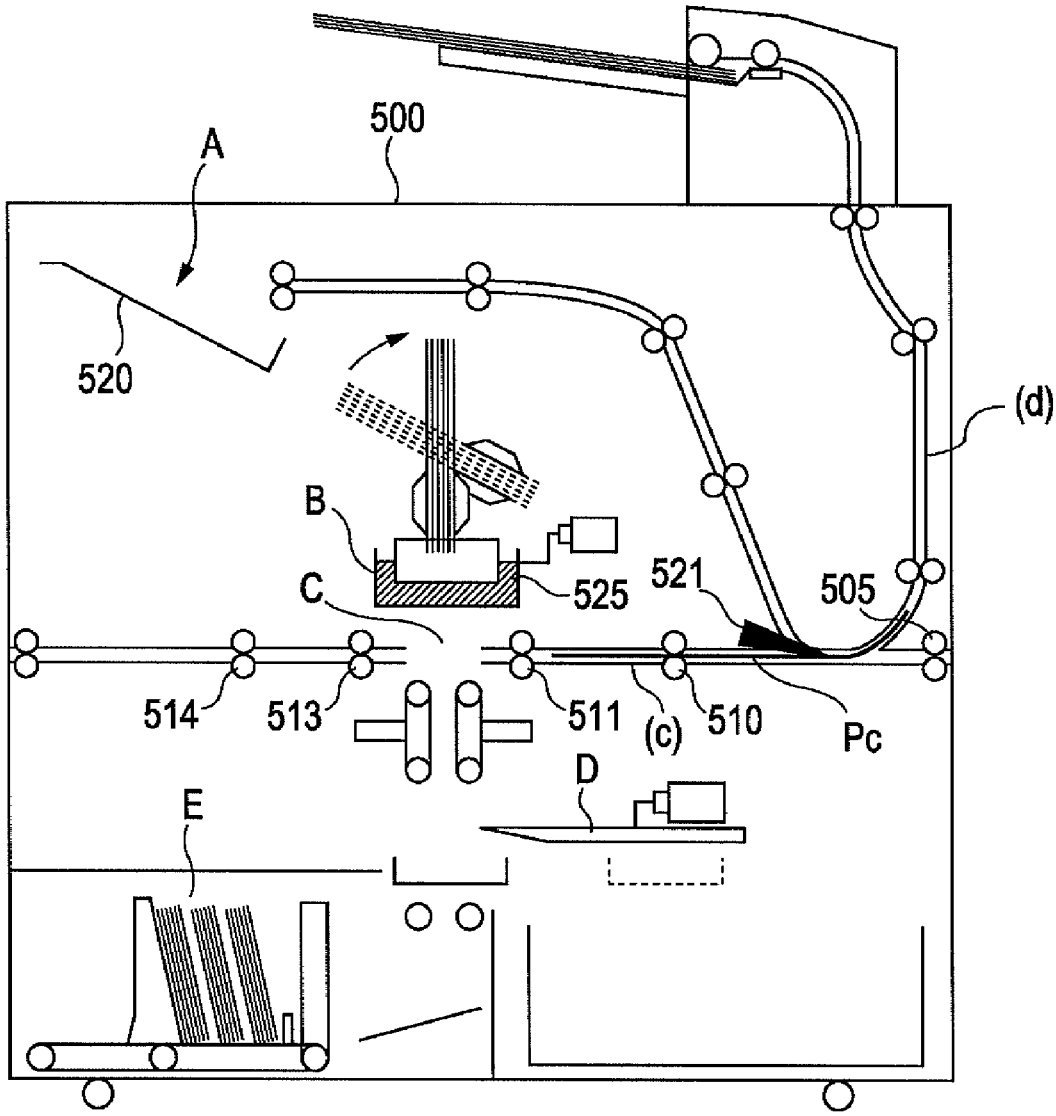

Then, the sheet flow of book binding by inserting a cover sheet through the inserter 300 will be described with reference to FIGS. 27 and 28. As described above with reference to FIGS. 23 to 26, a sheet is sequentially received from the image forming apparatus 10, the received sheets formed into a sheet bundle on the sheet loading tray 520, and the sheet bundle moved to the gluing unit B with the gluing gripper 523. When the cover sheet Pc is inserted through the inserter 300, as shown in FIG. 27, while a bundle of text sheets being moved from the sheet loading tray 520 to the gluing unit B, a cover sheet Pc is fed from a feeding tray 310 with a feed roller 301. The fed cover sheet is conveyed by conveying roller pairs 303, 503, and 504, and is led from a conveying path (d) to the conveying path (c) with the switching flapper 521. Next, operation of each component of the bonding book binding apparatus 500 will be described in detail.

(Gluing Unit)

Figure 3:
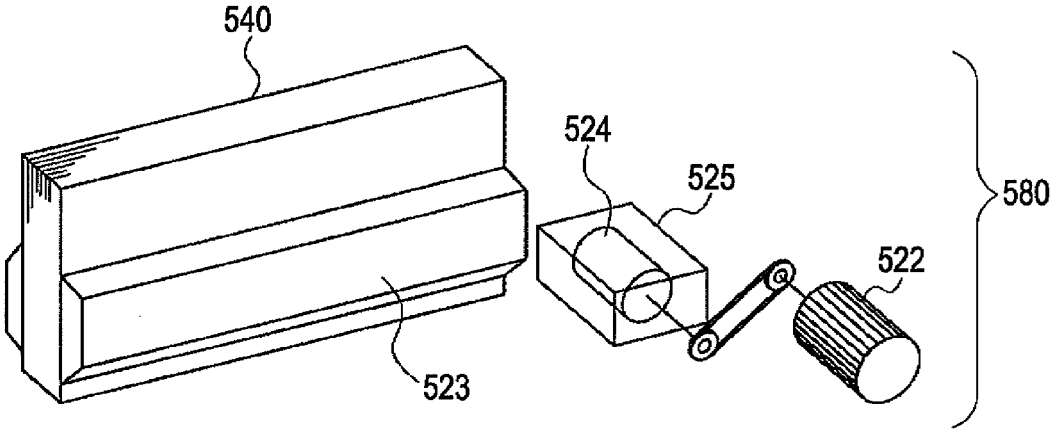
FIGS. 3 and 4 are schematic exemplary views illustrating a bonding unit.
Figure 4:
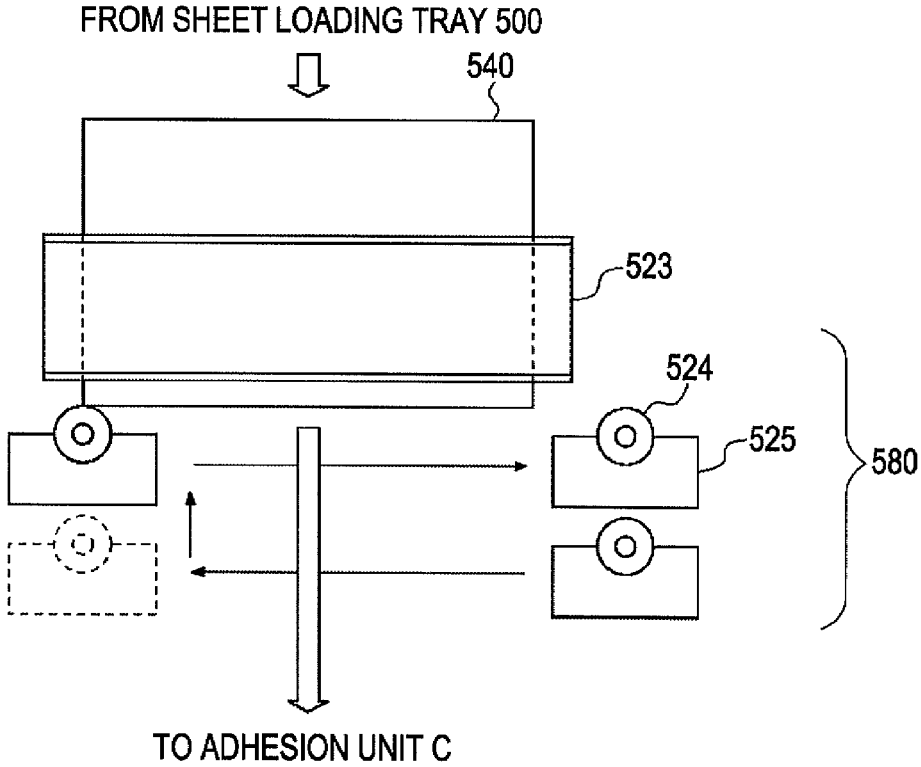

FIG. 3 is a configuration drawing of the gluing unit B, and FIG. 4 is a schematic view of the gluing operation in the gluing unit B. The gluing unit B includes the gluing gripper 523 for gripping a sheet bundle, the glue container 525 for containing glue, the glue applying roller 524 for applying glue onto the sheet bundle, and the glue applying roller control motor 522.

The glue applying roller 524 dipped into the glue container 525 is always rotating due to the rotation of the glue applying roller control motor 522. A glue applying unit 580 composed of the glue container 525, the glue applying roller 524, and the glue applying roller control motor 522 is moved by driving means (not shown) in a longitudinal direction in parallel with a lower side of the sheet bundle 540 gripped in an upright position by the gluing gripper 523. The glue is applied by the reciprocation of the glue applying unit 580. As shown in FIG. 4, the glue applying unit 580 starts moving from an initial position on the back side of the bonding book binding apparatus 500 and stops at a predetermined position on the front side of the bonding book binding apparatus 500. At this time, the glue is not applied by the glue applying unit 580. The glue application is executed during the movement from the front side to the back side of the bonding book binding apparatus 500. From the glue applying unit 580 which stops at the predetermined position, the glue applying roller 524 is raised to a position abutting the lower side of the sheet bundle. Then, the glue is applied to the lower side of the sheet bundle 540 by the glue applying roller 524 while the glue applying unit 580 is moving from the front side to the back side of the bonding book binding apparatus 500.

(Bonding Unit)

Figure 5:
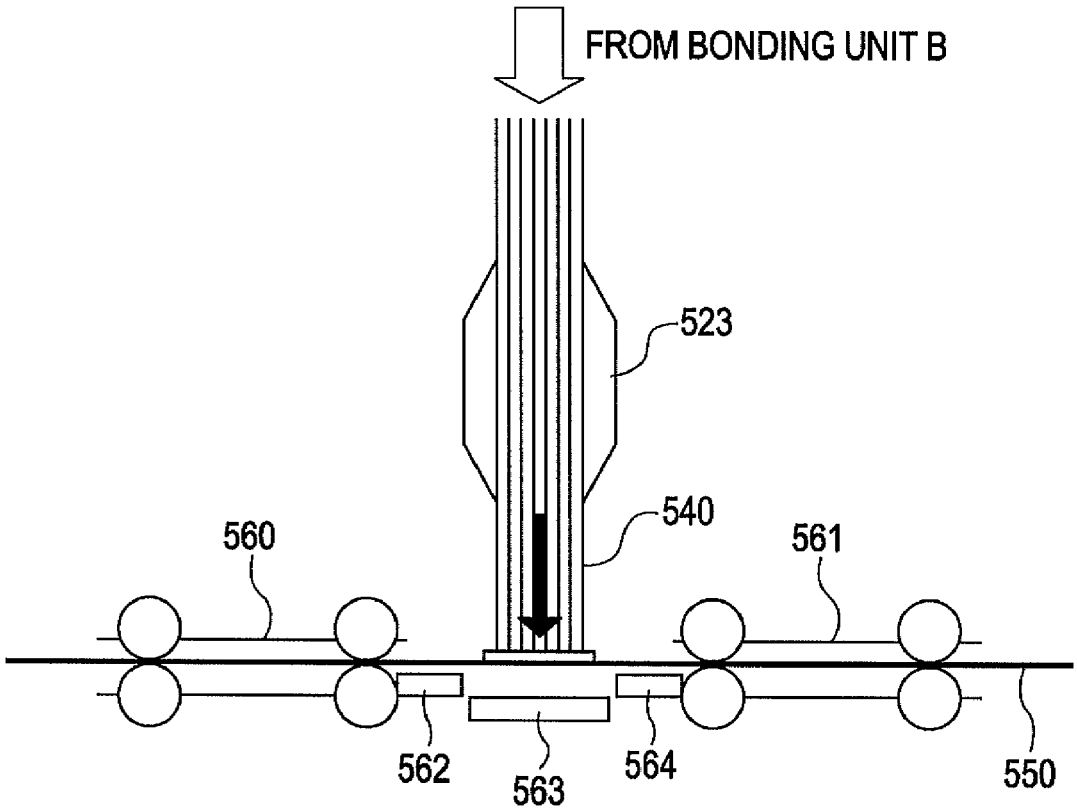
FIGS. 5 to 12 are schematic views illustrating an adhesion unit.
Figure 6:
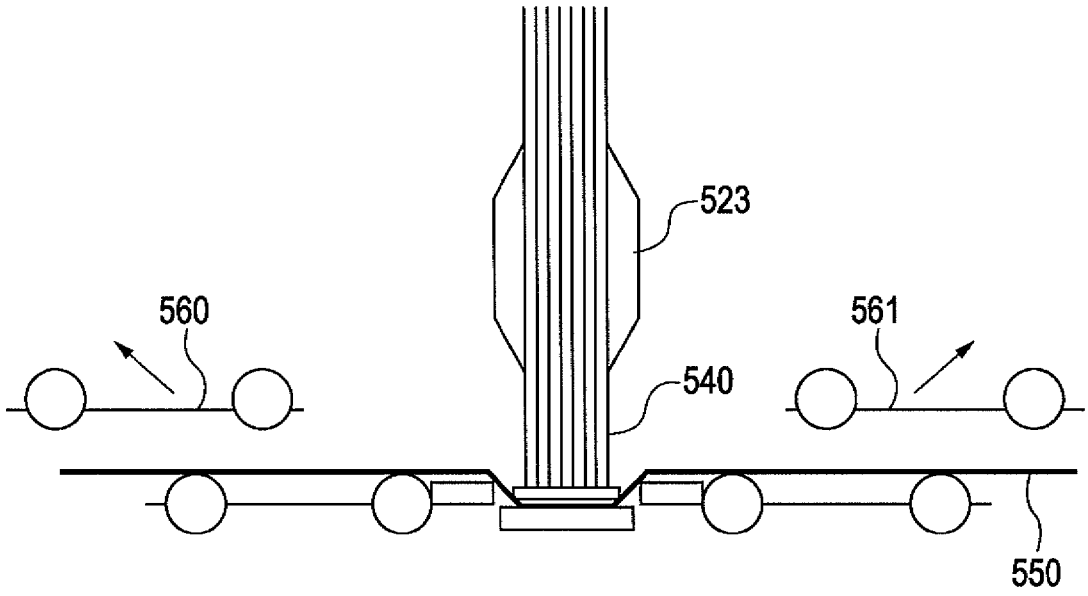
Figure 7:
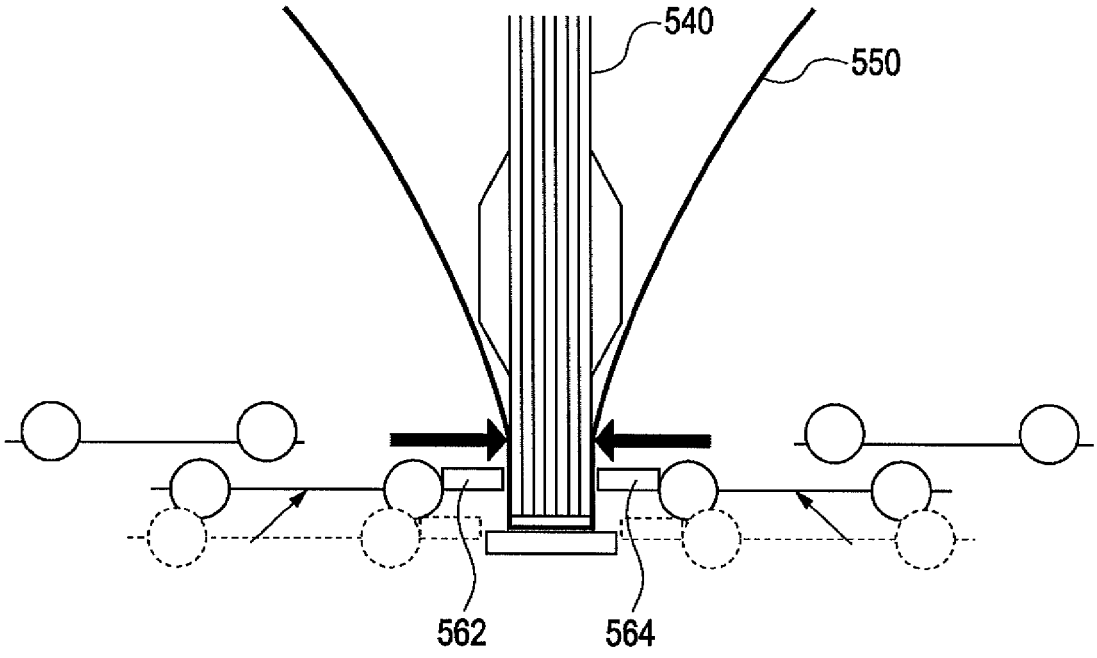
Figure 8:
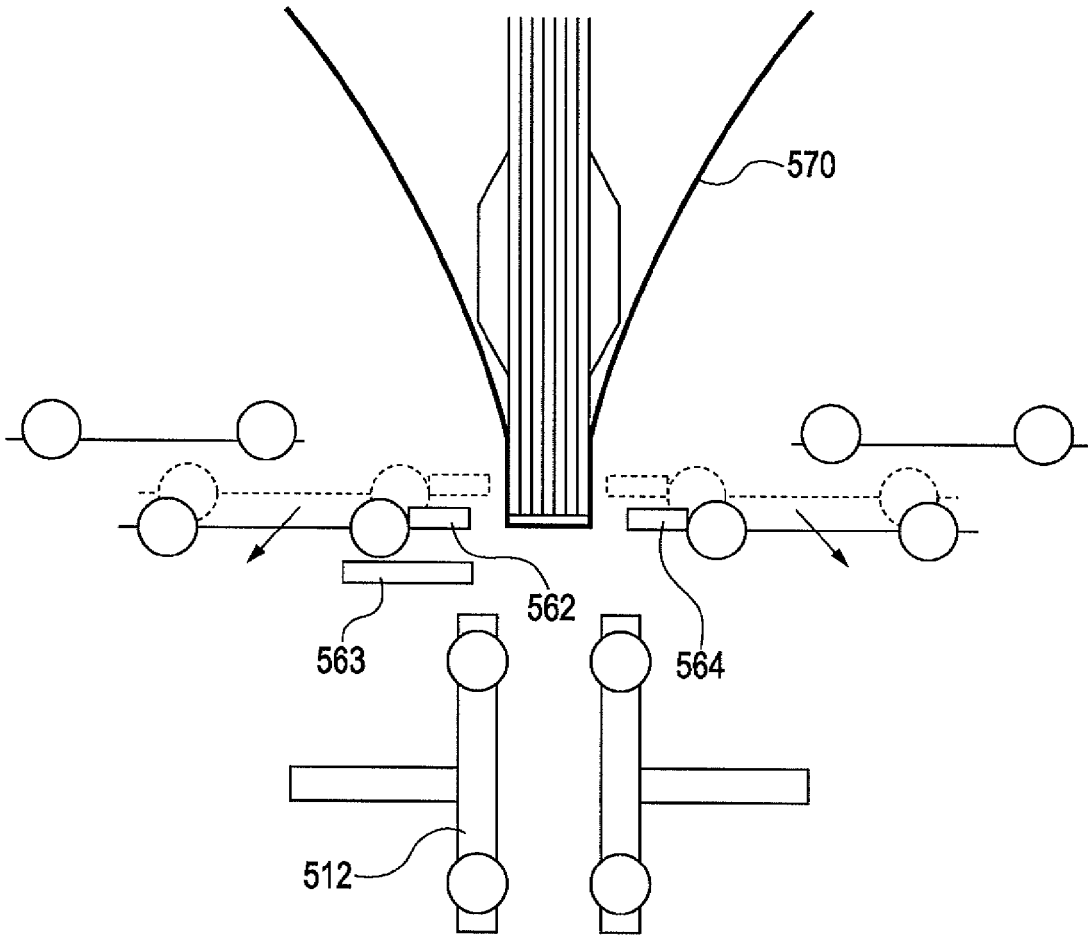

FIG. 5 is a sectional view of the bonding unit C. The bonding unit C includes conveying guides 560 and 561 for guiding a cover sheet 550 supplied from the image forming apparatus 10, a pressurizing member 563 for pressurizing the cover sheet 550 onto a glue application face of the sheet bundle 540, and folding members 562 and 564 for use during casing the sheet bundle in the cover sheet.

The operation flow of the bonding unit C will be described with reference to FIGS. 5 to 12. After the glue application onto the cover sheet 550, the gluing gripper 523 gripping the sheet bundle 540 is lowered from the gluing unit B by driving means (not shown). Then, the glue application face is bonded onto the cover sheet 550 horizontally guided with the conveying guides 560 and 561 (see FIG. 5).

After the bonding, the gluing gripper 523 is lowered to pressurize the sheet bundle 540 onto the cover sheet 550 on the pressurizing member 563, so that the cover sheet 550 is bonded on the sheet bundle 540. Before the pressurizing the glue application face by lowering the sheet bundle 540, upper part of the conveying guide 560 and upper part of the conveying guide 561 are evacuated so as to prevent the interference with the sheet bundle 540 (see FIG. 6).

After the cover sheet 550 is bonded on the sheet bundle 540, the folding members 562 and 564 and lower parts of the conveying guides 560 and 561 are slightly elevated higher than the pressurizing member 563 by driving means (not shown) so as to move from the broken-line position to the solid-line position. By the slight elevation of the folding members 562 and 564, the cover sheet 550 is upwardly raised so that the cover sheet 550 is curved at the glue application face edge for casing the sheet bundle 540 in the cover sheet 550 (see FIG. 7). After the casing in the cover sheet 550, the folding members 562 and 564 and lower parts of the conveying guides 560 and 561 are evacuated by the driving means (not shown) from the broken-line position to the solid-line position. Simultaneously, the pressurizing member 563 is also moved horizontally by driving means (not shown). By the horizontal movement of the pressurizing member 563, the booklet 570 can secure a space where it can be lowered by lowering means of the gluing gripper 523 (see FIG. 8).

Figure 9:
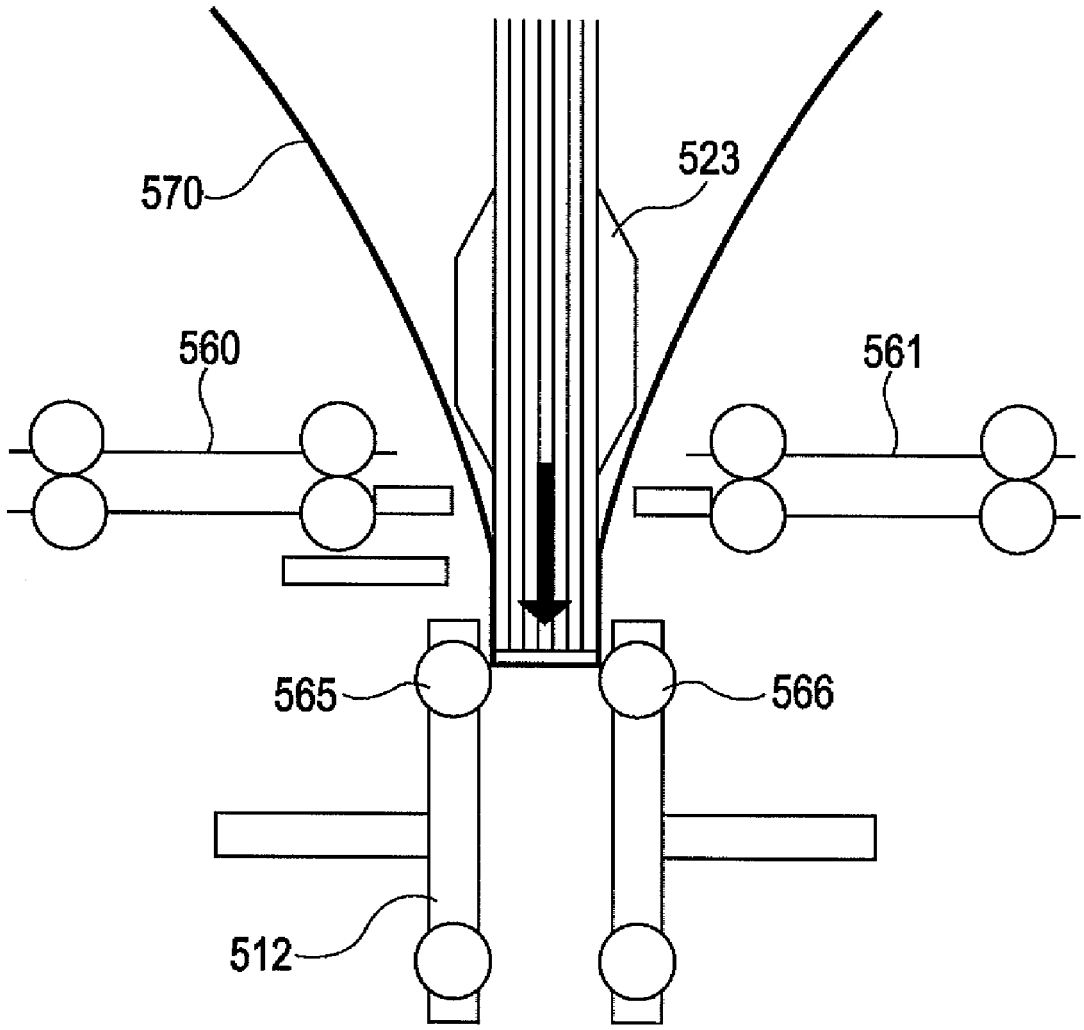
Figure 10:
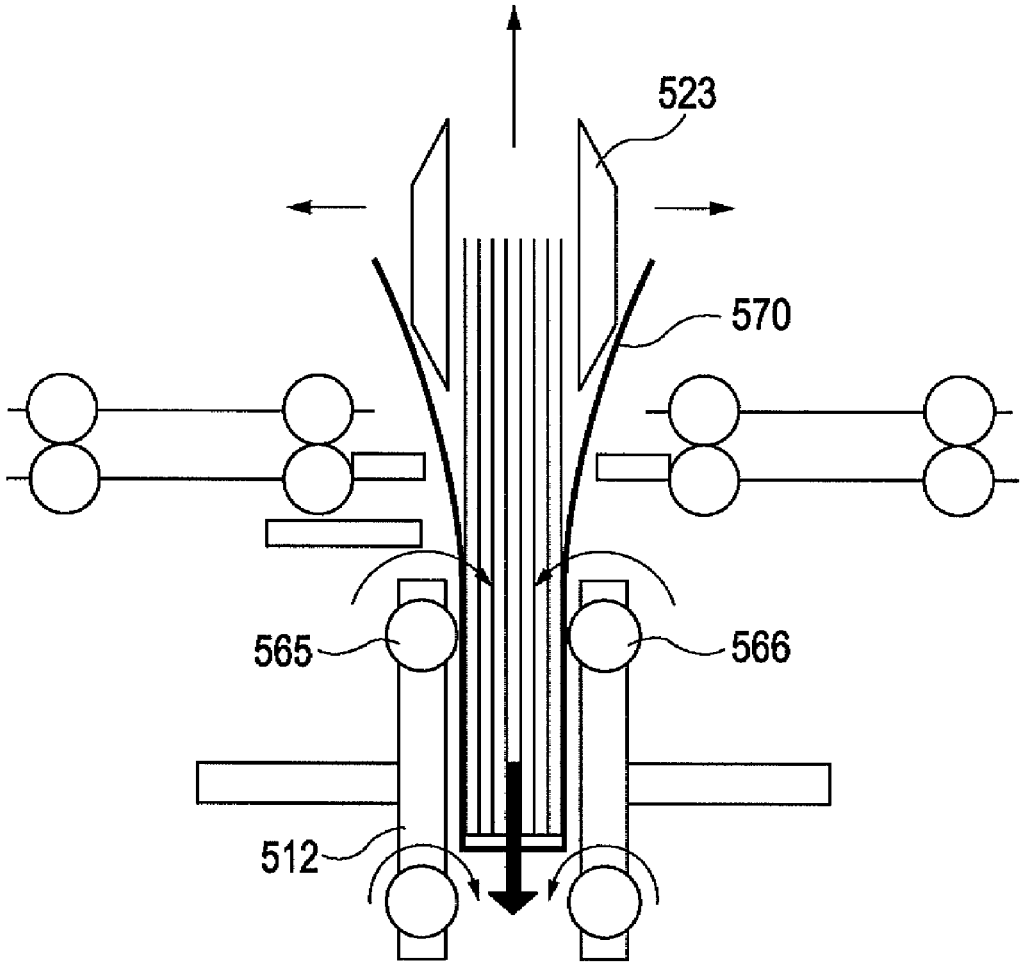
Figure 11:
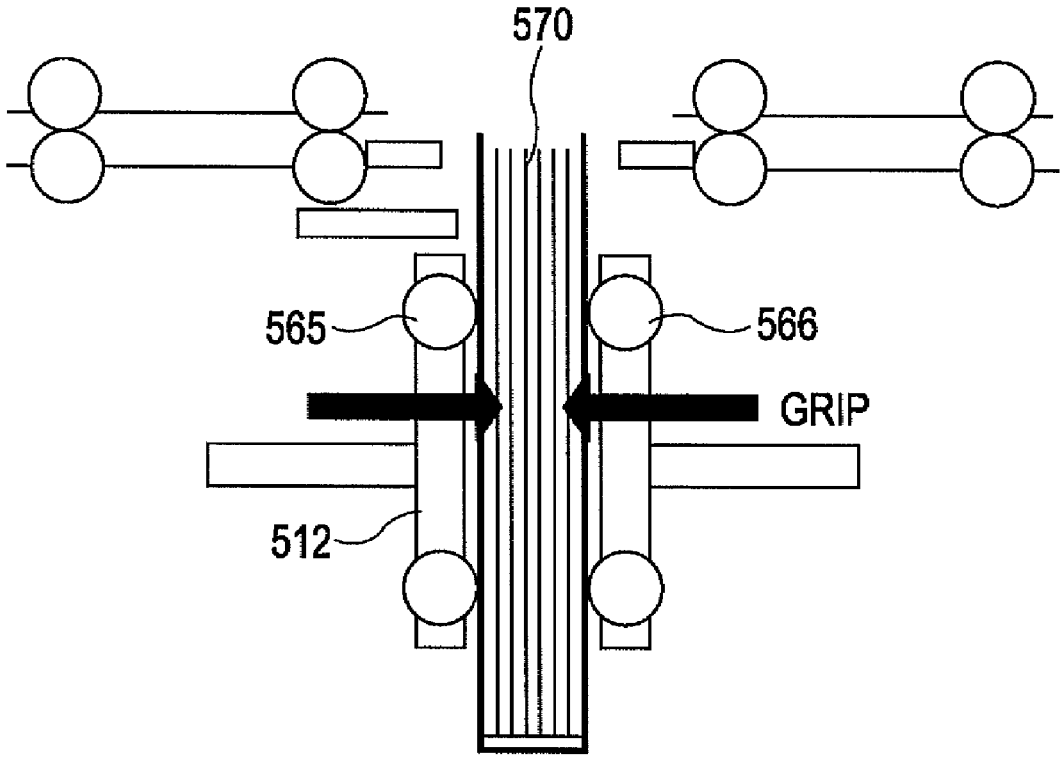

The booklet 570, lowered below the conveying guides 560 and 561 by the lowering means of the gluing gripper 523, descends to a position where its lower end abuts trim unit transfer rollers 565 and 566 (see FIG. 9). Then, the gluing gripper 523, which has gripped the booklet 570, releases the booklet 570 so that simultaneously, the booklet 570 is downwardly conveyed by the trim unit transfer rollers 565 and 566 (see FIG. 10).

The conveyance of the booklet 570 is stopped after the downward conveyance to a predetermined position by the trim unit transfer rollers 565 and 566. Thereafter, the trim gripper 512 grips the booklet 570 by driving means (not shown) (see FIG. 11). By lowering means (not shown) of the trim gripper 512, the booklet 570 is lowered to the position of the cutting unit D. At this time, the pressurizing member 563, which has moved in a horizontal direction, moves to a position where the bonding part of the book cover can be pressurized (see FIG. 12).

(Cutting Unit)

Figure 12:
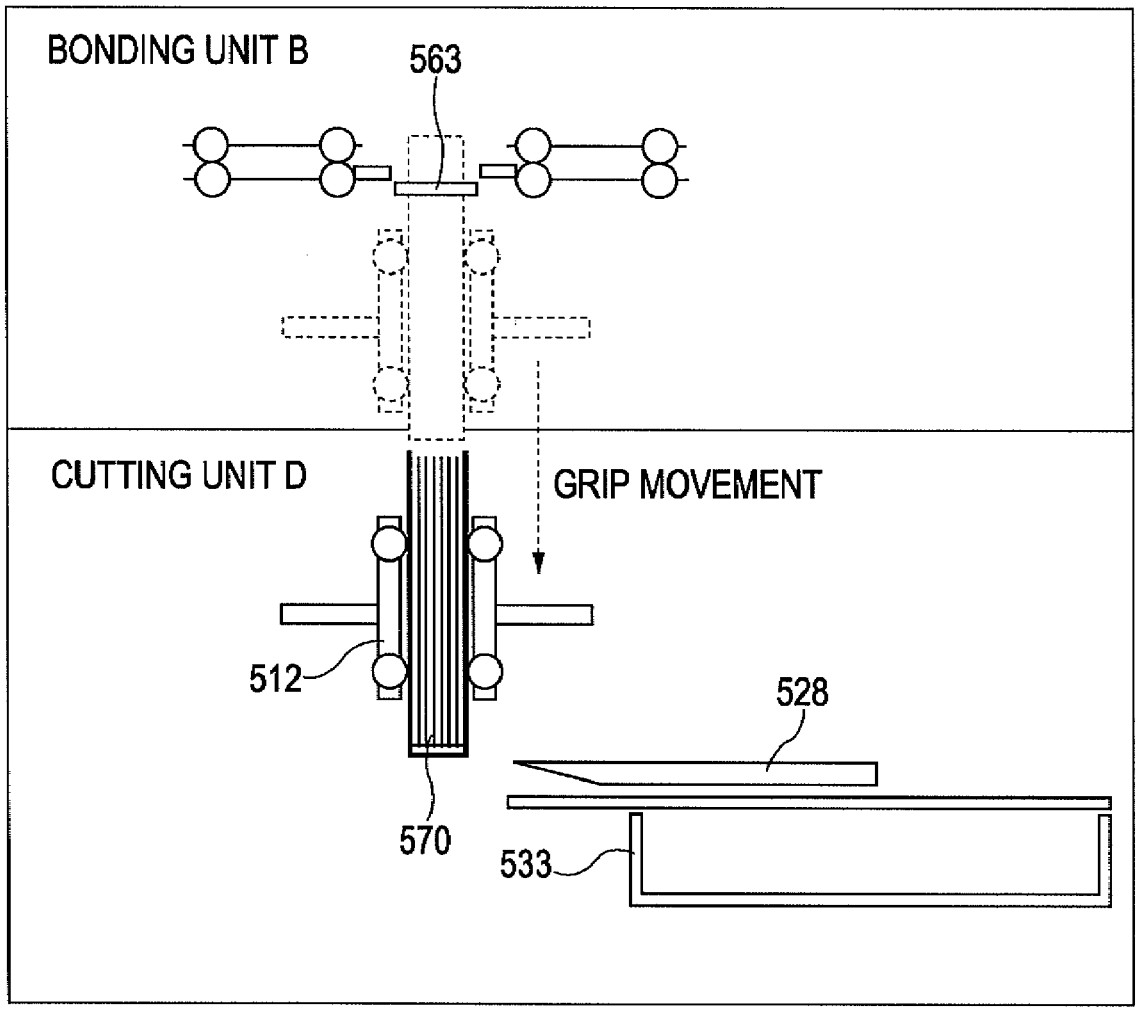
Figure 13:
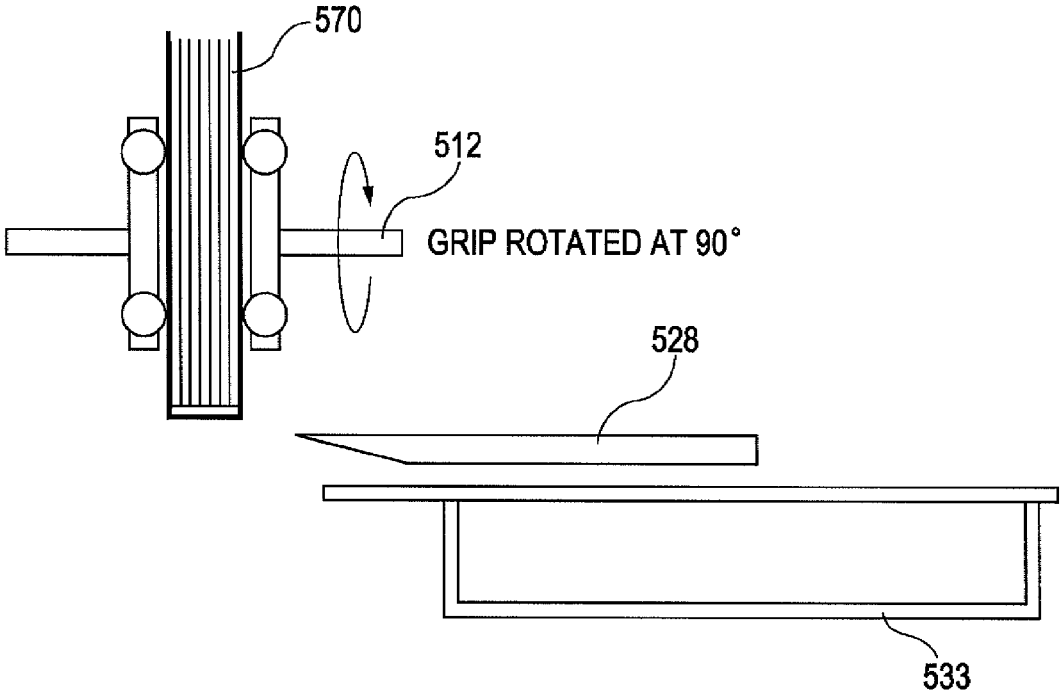
FIGS. 13 to 18 are schematic exemplary views illustrating a cutting unit.
Figure 14:
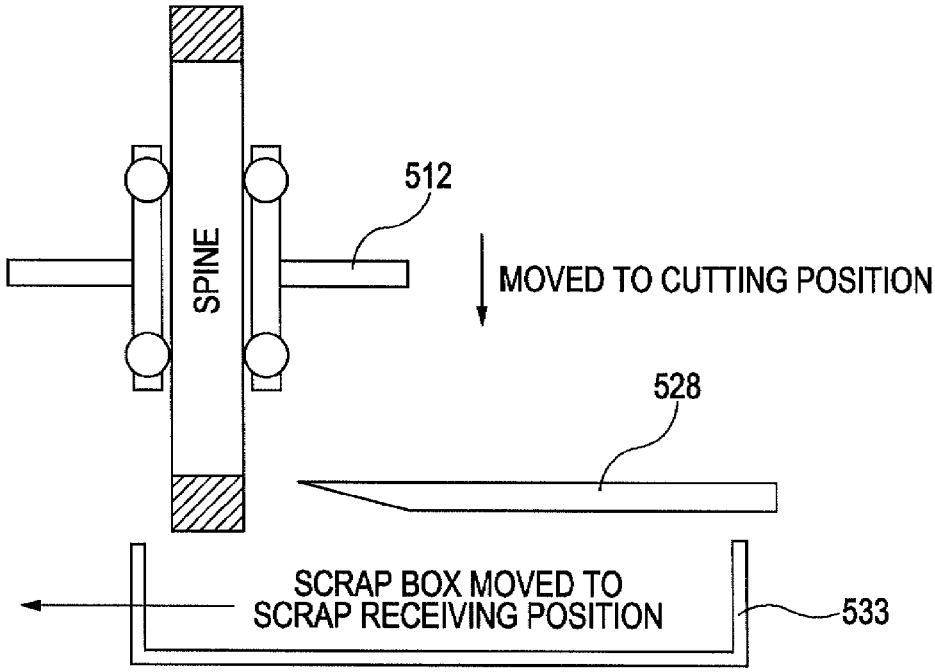
Figure 15:
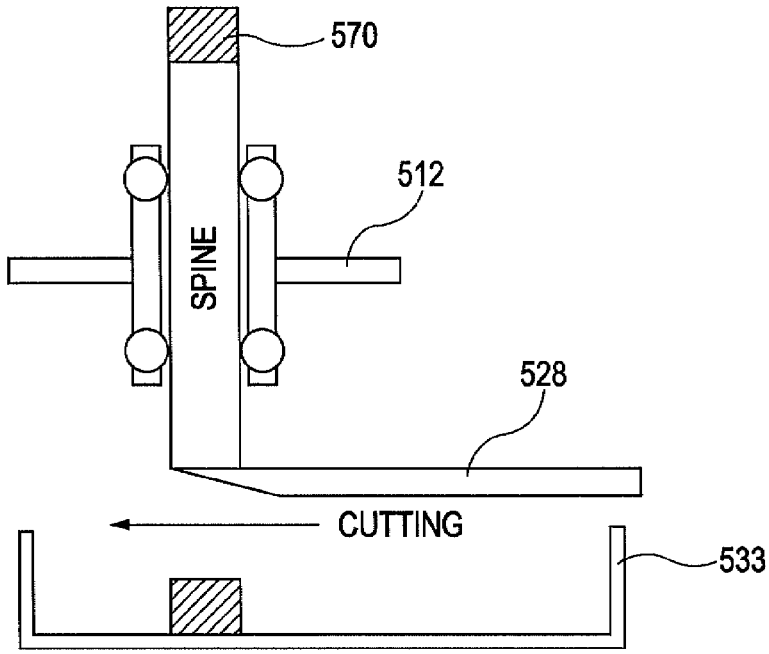
Figure 16:
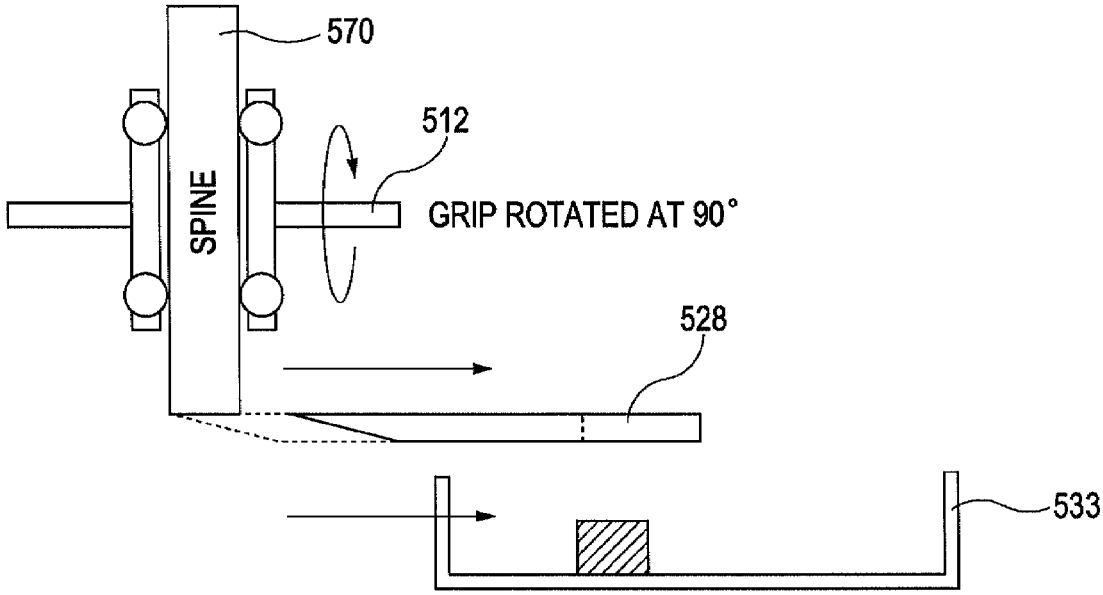
Figure 17:
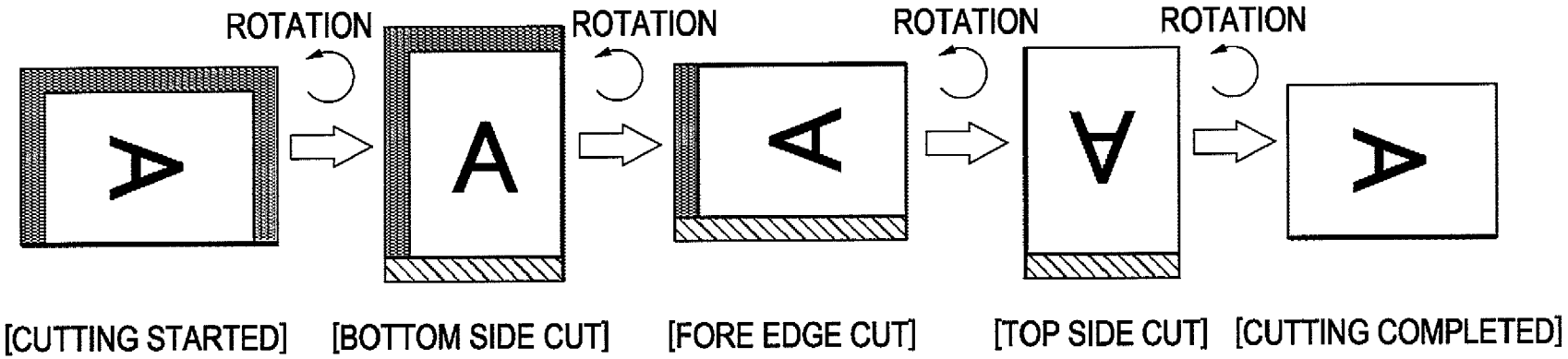

Next, the operation flow of the cutting unit D will be described with reference to FIGS. 12 to 18. As shown in FIG. 12, the booklet 570, in which the sheet bundle of text sheets has been bonded on the book cover in the above-mentioned bonding unit, is moved to the cutting unit D by the trim gripper 512 so that sides of the sheet bundle are cut by the cutter 528 drivingly in association with the trim gripper 512 and the scrap receiving box 533. First, the trim gripper 512 is rotated at 90° with the spine of the booklet 570 directed to this side of the drawing (see FIG. 13). After the scrap receiving box 533 is moved to below the booklet 570 (see FIG. 14), the cutter 528 comes in contact with the booklet 570 so as to cut one side thereof. At this time, cutting scraps are received in the scrap receiving box 533 waiting below the booklet 570 (see FIG. 15). Then, the cutter 528 is moved to an evacuation position by being reversely driven, and the scrap receiving box 533 is moved to an evacuation position (see FIG. 16).

The above-mentioned cutting operation is executed on three sides: the fore, upper, and lower edges of the booklet 570. Since the bonded booklet 570 is moved with the spine downwardly directed, the lower side is cut after the booklet 570 is rotated at 90° by rotating the rotatable trim gripper 512 by 90°. Then, the trim gripper 512 is rotated at 90° in the same direction so as to cut the fore edge. Furthermore, the trim gripper 512 is further rotated at 90° so as to cut the upper side, completing the cutting of the booklet 570 other than the spine edge. However, since the cut booklet 570 is conveyed with the spine downwardly directed to the bound book discharge unit (which will be described below), the booklet 570 is further rotated 90° by the trim gripper 512 without the cutting (see FIG. 17).

Figure 18:
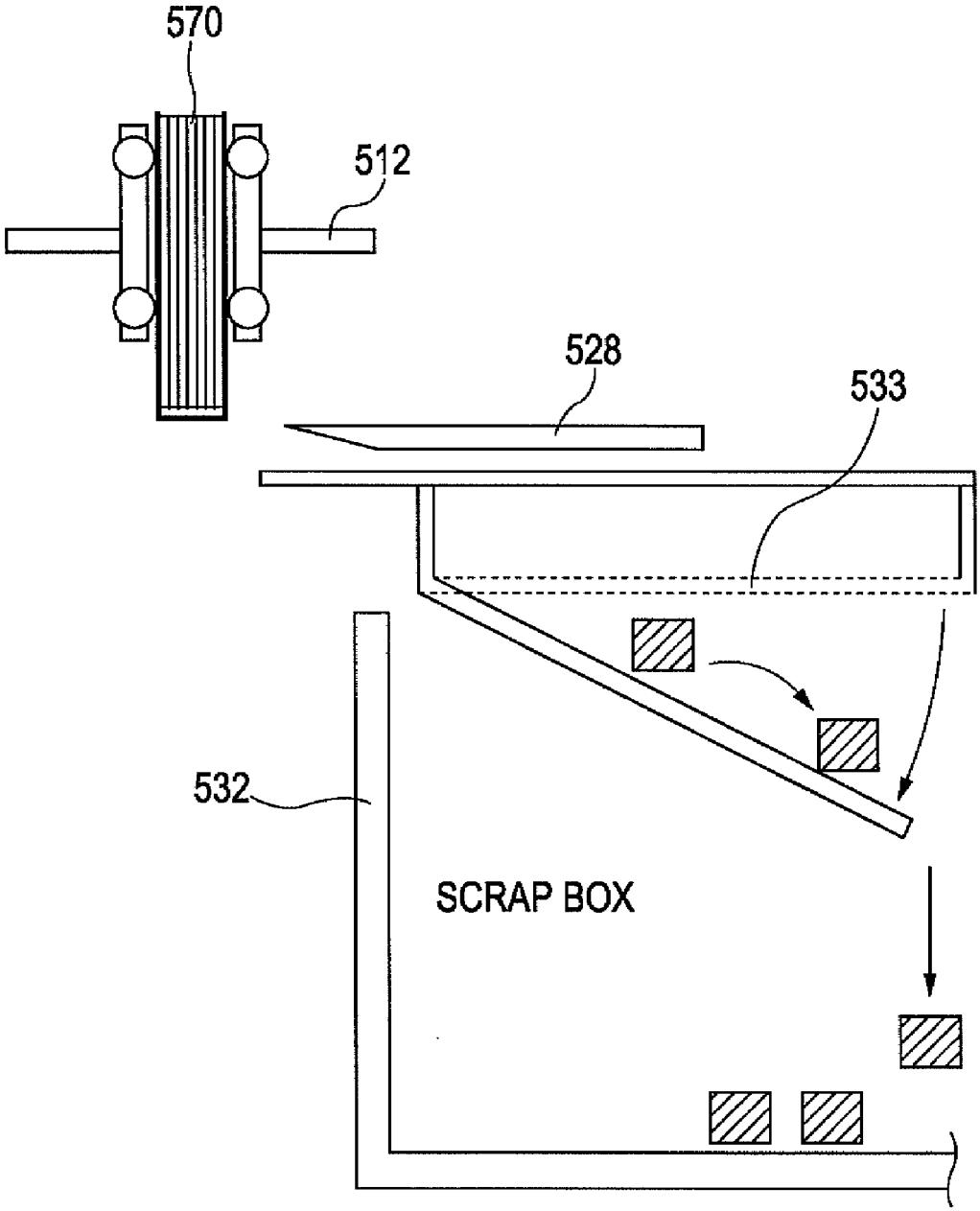

The scrap receiving box 533 reciprocates between the evacuated position when the cutting is not executed and the scrap receiving position when the cutting is executed. The evacuated position is located above a cutting trash box 532. As shown in FIG. 18, the bottom of the scrap receiving box 533 can be opened, so that when the scrap receiving box 533 is moved to the evacuated position, the bottom is opened for accumulating cutting scraps into the cutting trash box 532.

(Bound Book Discharge Unit)

Figure 19:
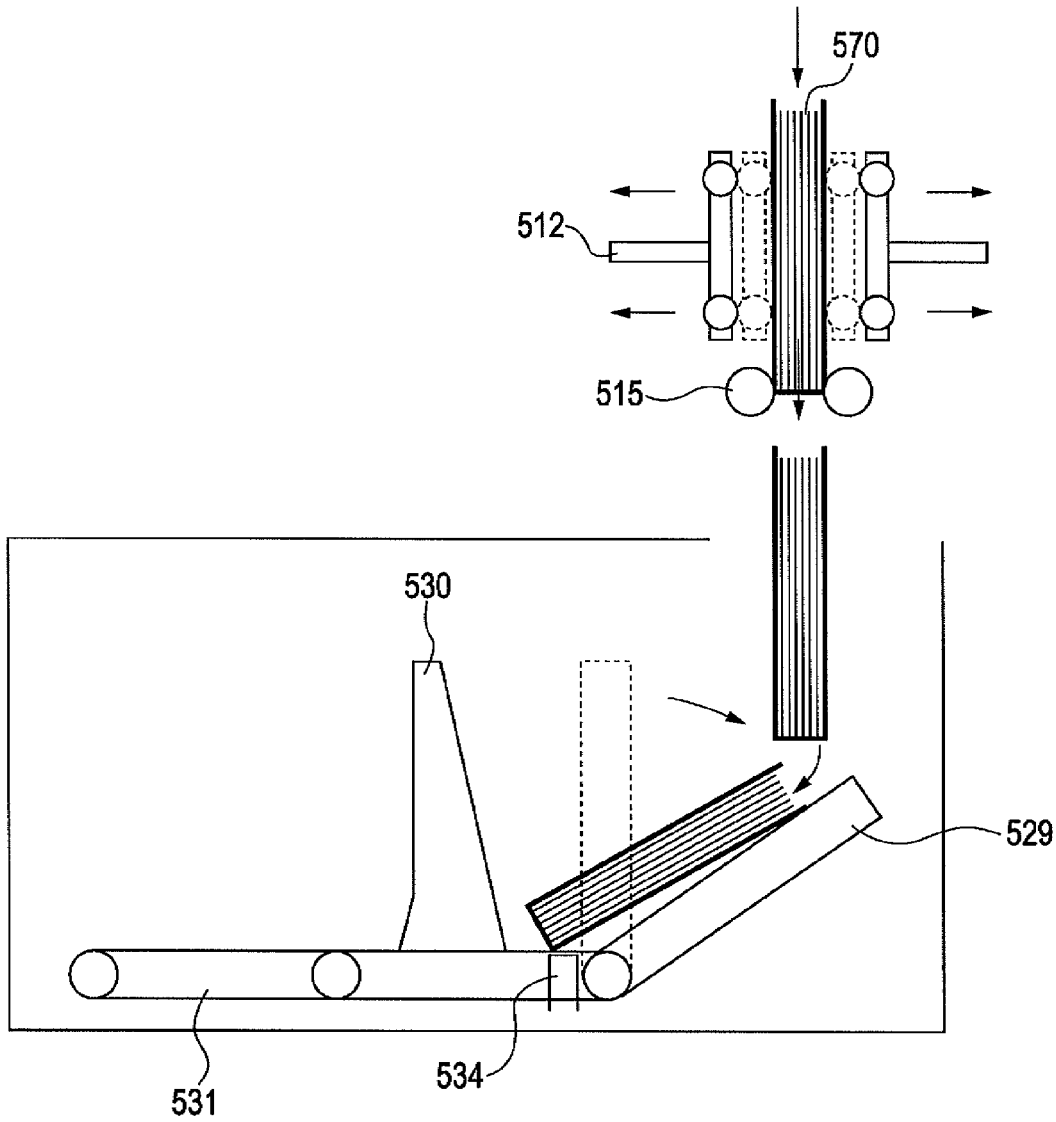
FIGS. 19 to 22 are schematic exemplary views illustrating a book-binding discharge unit.
Figure 20:
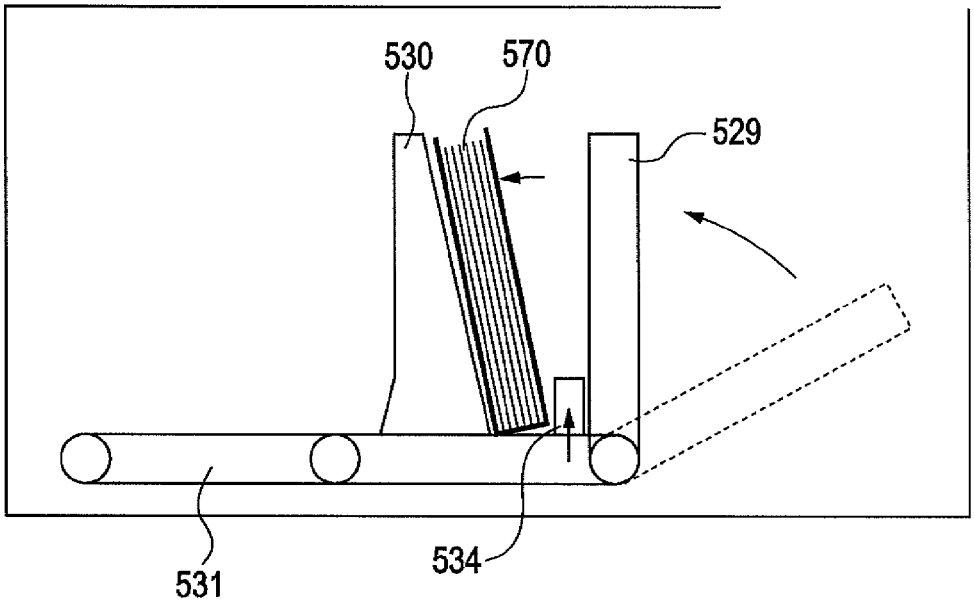

FIG. 19 is a sectional view of the bound book discharge unit E and a book binding buffer F. These sections include the trim gripper 512 for conveying a booklet from the cutting unit D to the bound book discharge unit E, discharge rollers 515 for conveying the booklet to the bound book discharge unit E, a loading plate 529 for temporarily loading the conveyed booklet thereon, a bound book support plate 530 for supporting a bound book in the vertical direction, a loading stabilizer 534, and a discharge conveying belt 531 for horizontally moving the bound book support plate 530. The book binding buffer F denotes the section of the discharge rollers 515. When the bound book discharge unit E is drawn out for taking out a sheet bundle, the sheet bundle is gripped by the discharge rollers 515.

The operation flow of the bound book discharge unit E will be described with reference to FIGS. 19 to 22. After the cutting operation, the booklet 570 is conveyed by lowering means (not shown) of the trim gripper 512 to the discharge rollers 515 arranged directly below the cutting unit. Then, the booklet 570 is conveyed by the discharge rollers 515, and the trim gripper 512 releases the booklet 570, which is moved to a predetermined position in the bonding unit C. At this time, in the bound book discharge unit E, the loading plate 529 falls in the right direction, and the booklet 570 is loaded onto the loading plate 529 by the discharge rollers 515 (see FIG. 19).

Figure 21:
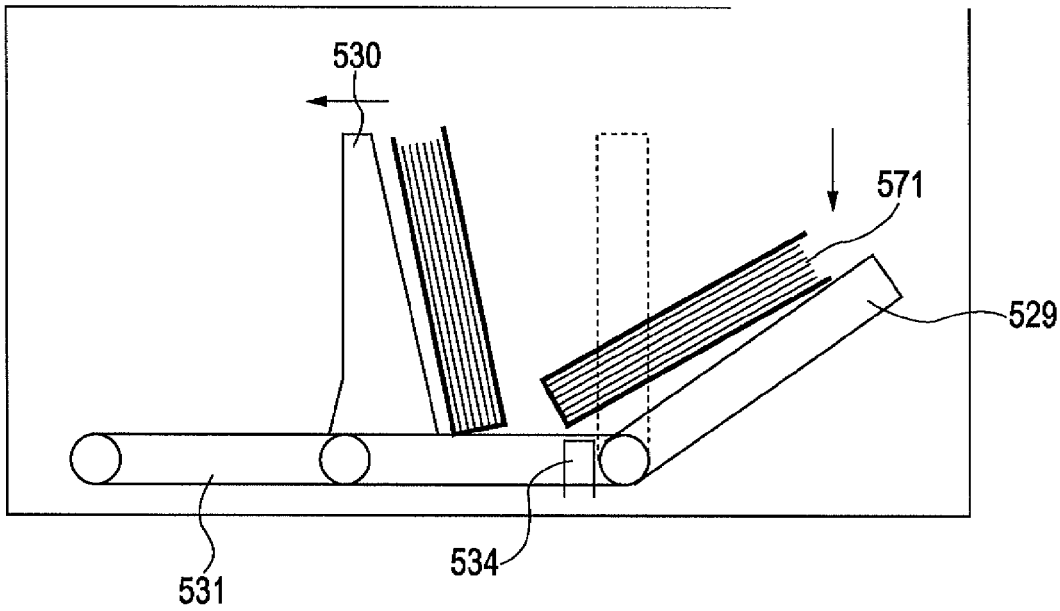
Figure 22:
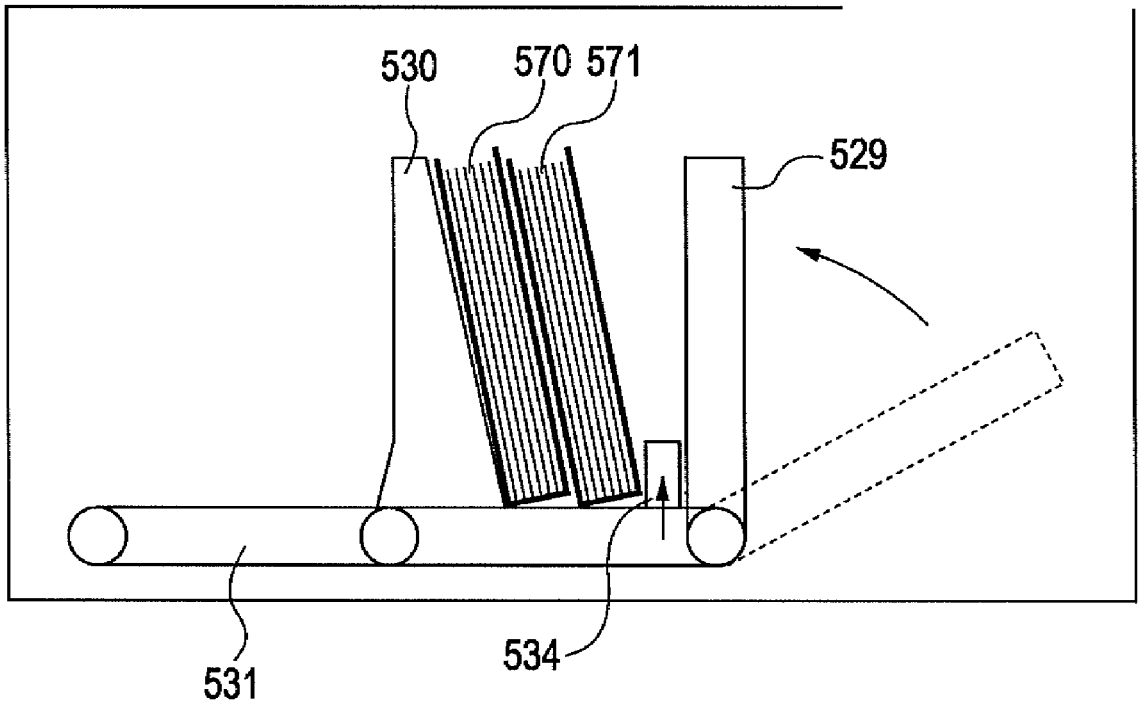

Then, the fallen loading plate 529 is raised upright, and the booklet 570 is vertically supported to the bound book support plate 530. The loading stabilizer 534 arranged below the discharge conveying belt 531 is upwardly moved by raising means (not shown) so as to support the booklet 570 between the bound book support plate 530 and the loading stabilizer 534 (see FIG. 20). Then, the bound book support plate 530 is moved to the left for securing a discharge space of a next booklet 571 (see FIG. 21). Referring to FIG. 21, the booklet 570 and the booklet 571 can be vertically positioned close to each other by securing the discharge space for the booklet 571 and executing the above-operation.

(Operation Display Unit)

Figure 29:
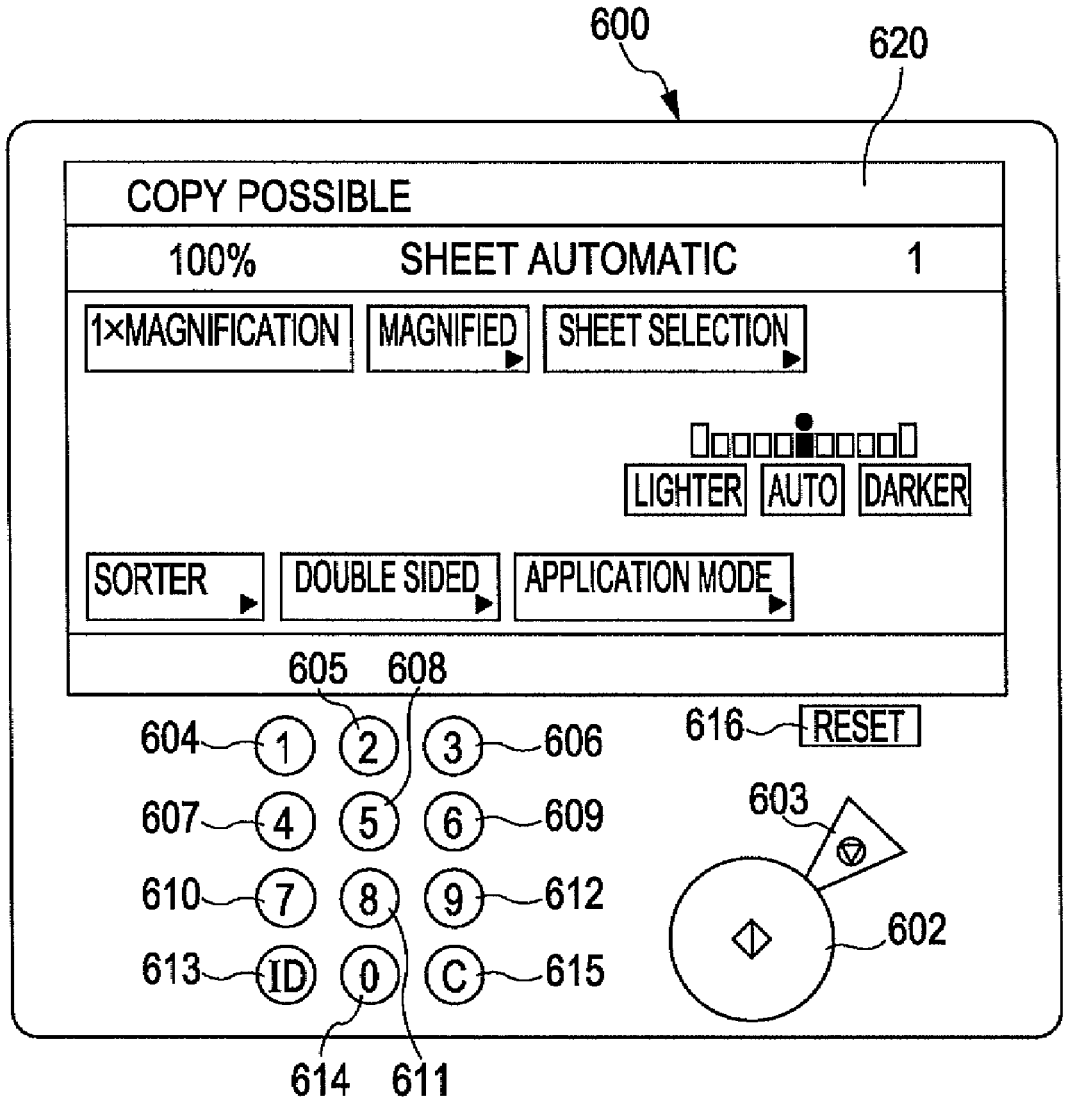
FIG. 29 is an exemplary view of an operation display unit.

FIG. 29 is a drawing of an operation display unit 600 of the image forming apparatus shown in FIG. 1. The operation display unit 600 includes a start key 602 for starting image forming operation, a stop key 603 for stopping the image forming operation, numeric ten keys 604 to 612 and 614 for registration, an ID key 613, a clear key 615, and a reset key 616, which are arranged thereon. In an upper portion of the operation display unit 600, there is provided a liquid crystal display 620 having a touch panel capable of having soft keys on its screen. For example, the image forming apparatus 10 according to the embodiment includes various processing modes, such as a non-sorting mode, a sorting mode, and a book binding mode, as a processing mode of the after treatment device 400 and the bonding book binding apparatus 500. Such a processing mode can be set by the inputting operation through the operation display unit 600.

(System Block Diagram)

Figure 30:
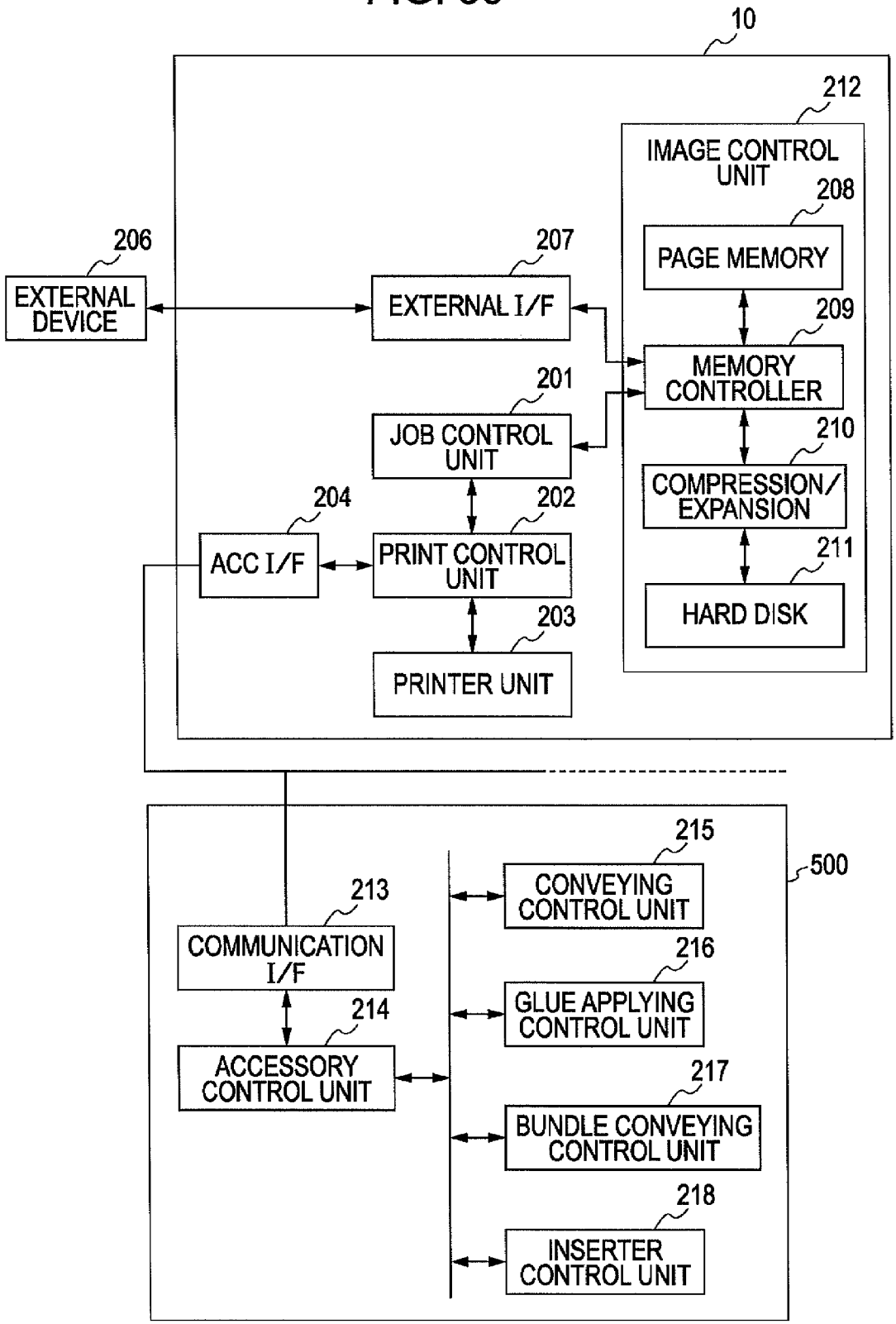
FIG. 30 is a block diagram of hardware.

Then, the electrical configuration of a control circuit necessary for controlling the image forming system will be described with reference to the block diagram of FIG. 30. First, reference numeral 206 denotes an external device, such as a personal computer (PC) and an image scanner, for transmitting a print job to the image forming apparatus 10. The print job includes image data and printing data. The printing data are the information necessary for printing, such as sheet supplying devices for the printing and printed sheet discharging devices. The print job transmitted from the external device 206 is received by an external I/F 207 of the image forming apparatus 10. The print job received by the external I/F 207 is transmitted to a memory controller 209.

The memory controller 209 extracts the image data from the print job so as to transmit the image data to a compression/expansion unit 210. Since the image data is compressed, the image data received by the compression/expansion unit 210 is converted into internal data. The image data converted into the internal data is stored in a hard disk 211. The hard disk 211 may be replaced with other large capacity storing means.

On the other hand, the memory controller 209 extracts the printing data from the print job so as to transmit the printing data to a job control unit 201. Upon receiving the printing data, the job control unit 201 starts sending an operation start signal to a print control unit 202 for starting printing operation. Then, upon receiving the signal, the print control unit 202 sends the starting operation signal to the printer unit 203 as well as to the bonding book binding apparatus 500 and the after treatment device 400 used by the print job via an ACC I/F 204. The bonding book binding apparatus 500 sends/receives control data via a communication I/F 213. Also, the communication I/F 213 exchanges the sent/received data with an accessory control unit 214. The accessory control unit 214 is a block for generally controlling the bonding book binding apparatus 500.

The accessory control unit 214 exchanges the control information with the image forming apparatus 10 via the communication I/F 213, and when a sheet conveyed from the image forming apparatus 10 arrives at the inlet of the conveying path of the bonding book binding apparatus 500, the accessory control unit 214 informs a conveying control unit 215 of conveying the sheet to a predetermined position. The conveying control unit 215 conveys the received sheet to any one of the sheet loading unit A, the bonding unit C, and the after treatment device 400 connected in the downstream. When the sheet loaded onto the sheet loading unit A is completed, the accessory control unit 214 controls a glue applying control unit 216 for controlling the glue applying unit to the sheet bundle and a bundle conveying control unit 217 for conveying the sheet bundle from the sheet loading unit A to the bound book discharge unit E via the bonding unit C and the cutting unit D for the book binding operation.

On the other hand, upon completing the operation start preparation of the printer unit 203 and the bonding book binding apparatus 500, the job control unit 201 demands the image data of every page from the memory controller 209. The memory controller 209 reads the image data converted into the internal data out of the hard disk 211 so as to expand the internal data into bit map data, which can be printed by the image forming apparatus 10, in the compression/expansion unit 210, and to store the bit map data in a page memory 208.

The job control unit 201 transmits the bit map data sent from the memory controller 209 to the printer unit 203 via the print control unit 202. The print control unit 202 instructs the printer unit 203 to form images as well as instructs the feeding device to start conveying a sheet. The print control unit 202 also transmits the sheet information to the discharge device in accordance with the sheet conveying route via the ACC I/F 204. Upon completing the print job, the job control unit 201 further instructs the print control unit 202 to complete the operation. The print control unit 202 instructs any of the after treatment device 400 and the bonding book binding apparatus 500 if necessary to complete the operation via the ACC I/F 204, and it instructs the printer unit 203 to complete the operation. During executing the print job by the print control unit 202, if a next print job comes from the external device 206, the image data is stored in the hard disk 211 via the memory controller 209, and the printing data is stored in the job control unit 201. When the present print job is completed, the next print job is sequentially executed.

When the conveying control unit 215 of the bonding book binding apparatus 500 detects a sheet conveying malfunction (jamming) during conveying a sheet, the conveying control unit 215 informs the accessory control unit 214 of the jamming. Upon receiving the jamming information, the accessory control unit 214 stops operation.

Figure 31:
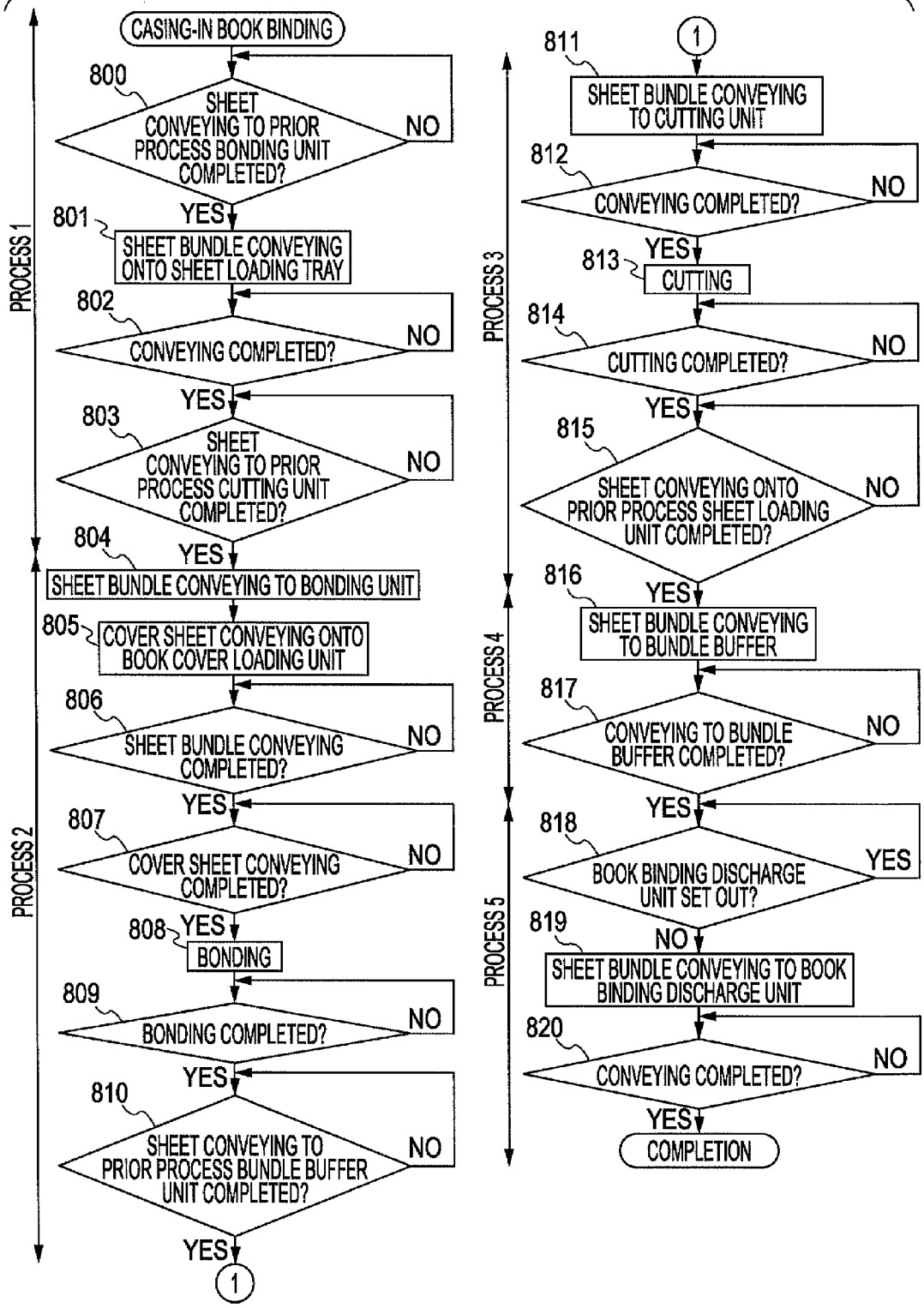
FIG. 31 is a flowchart illustrating a control method of a bonding book binding apparatus.

Next, the operation of the bonding book binding apparatus 500 forming a plurality of book binding bundles will be described with the flowchart of FIG. 31 and the sequence diagram of FIG. 32. This flowchart is employed for the execution by the accessory control unit 214 of the bonding book binding apparatus 500. First, the accessory control unit 214 waits for the previous bundle to complete moving from the sheet loading tray 520 to the gluing unit B (Step 800). After the moving completion, the accessory control unit 214 starts loading a sheet onto the sheet loading tray 520 (Step 801) so as to wait for the loading completion (Step 802). Upon the loading completion, the accessory control unit 214 waits for the previous sheet bundle conveyed from the sheet loading tray 520 to the gluing unit B to be conveyed to the cutting unit D (Step 803). When the previous sheet bundle is conveyed to the cutting unit D, the accessory control unit 214 conveys the sheet bundle loaded onto the sheet loading tray 520 to the gluing unit B (Step 804). Thereafter, the accessory control unit 214 starts conveying a cover sheet Pc (Step 805). Then, the accessory control unit 214 waits for the sheet bundle to be conveyed to the gluing unit B (Step 806). Upon conveying completion of the sheet bundle to the gluing unit B, the accessory control unit 214 waits for conveying completion of the cover sheet Pc (Step 807).

Then, the accessory control unit 214 starts gluing operation (Step 808) and waits for the gluing completion (Step 809). Upon the gluing completion, the accessory control unit 214 waits for the previous sheet bundle to escape from the cutting unit D and to be conveyed to the book binding buffer F (Step 810). Upon the conveying completion of the previous sheet bundle, the accessory control unit 214 starts conveying the glued sheet bundle to the cutting unit D (Step 811) and waits for the conveying completion (Step 812). Upon the conveying completion, the accessory control unit 214 starts cutting (Step 813) and waits for the cutting completion (Step 814). Then, the accessory control unit 214 waits for the previous sheet bundle to be conveyed to the bound book discharge unit E (Step 815). Thereafter, the accessory control unit 214 starts conveying the cut sheet bundle to the book binding buffer F (Step 816) and waits for the conveying completion (Step 817). Furthermore, the accessory control unit 214 examines whether the bound book discharge unit E is taken out. When it is taken out, the accessory control unit 214 waits for the bound book discharge unit E to be returned (Step 818). Then, the accessory control unit 214 starts discharging operation to the bound book discharge unit E (Step 819) and waits for the discharging completion (Step 820).

Figure 32:
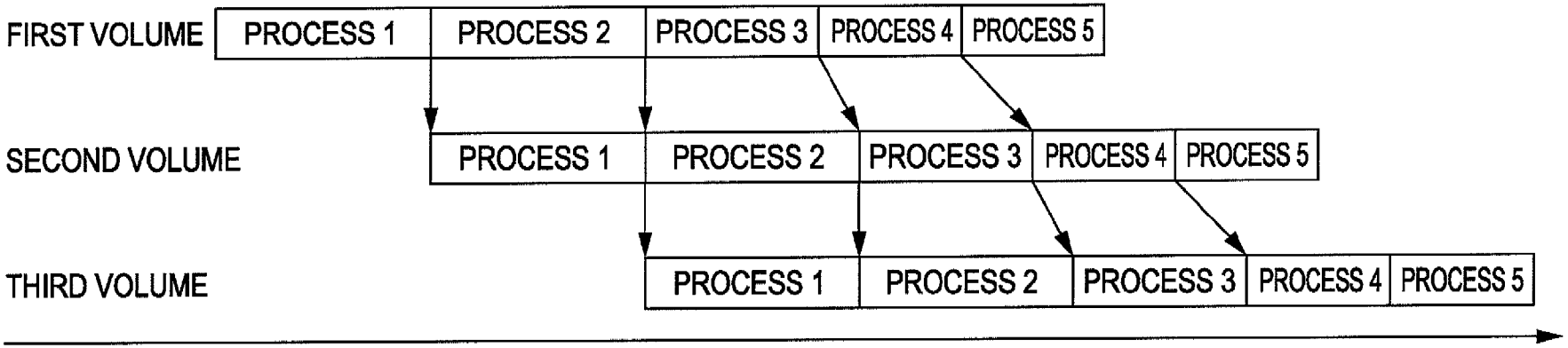
FIG. 32 is a first diagram illustrating the control method of the bonding book binding apparatus.

The sequence diagram of FIG. 32 schematically illustrates binding three booklets in parallel operation, in which Process 1 indicates Step 800 to Step 803; Process 2 Step 804 to Step 810; Process 3 Step 811 to Step 815; Process 4 Step 816 to Step 818; and Process 5 Step 819 and Step 820. When each process is completed, the next process is executed.

Figure 33:
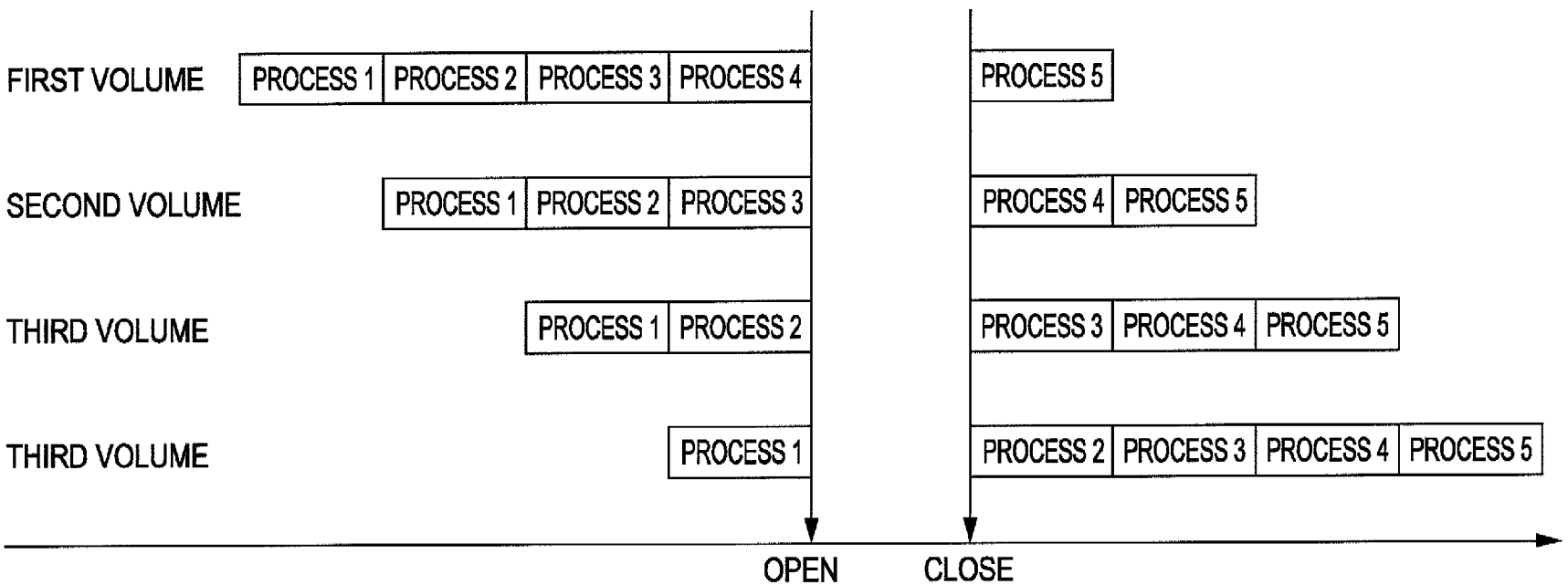
FIG. 33 is a second diagram illustrating the control method of the bonding book binding apparatus.
Figure 34:
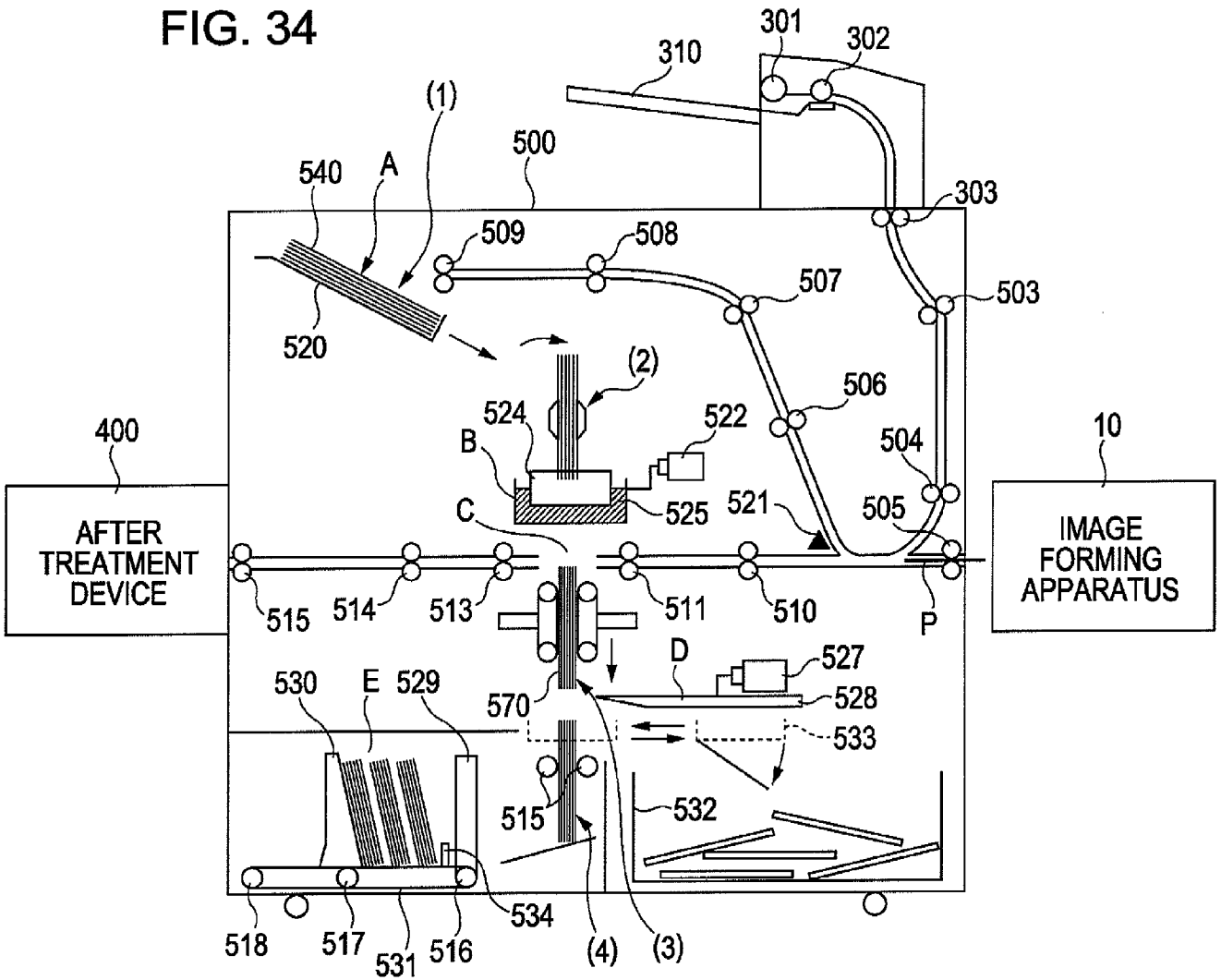
FIG. 34 is an arrangement drawing of four sheet bundles (1), (2), (3), and (4) in the apparatus.

The sequence diagram of FIG. 33 shows the state of each process when the bound book discharge unit E is taken out at a certain time for taking out the bound bundle in the middle of the book binding operation. During performing Process 4 on a first volume bound bundle, if the bound book discharge unit E is taken out, a second volume bound bundle is stopped at Process 3; a third volume bound bundle is stopped at Process 2; and a fourth volume bound bundle is stopped at Process 1. The state of sheet bundles in the bonding book binding apparatus 500 at this time is shown in FIG. 34. Within the bonding book binding apparatus 500, four volumes of sheet bundles reside. The downward conveying cannot be done at this time. Furthermore, no more new sheet bundle can be received. Then, when the bound book discharge unit E is returned, each Process is started so that the bound bundle is sequentially discharged to the bound book discharge unit E.

Figure 37:
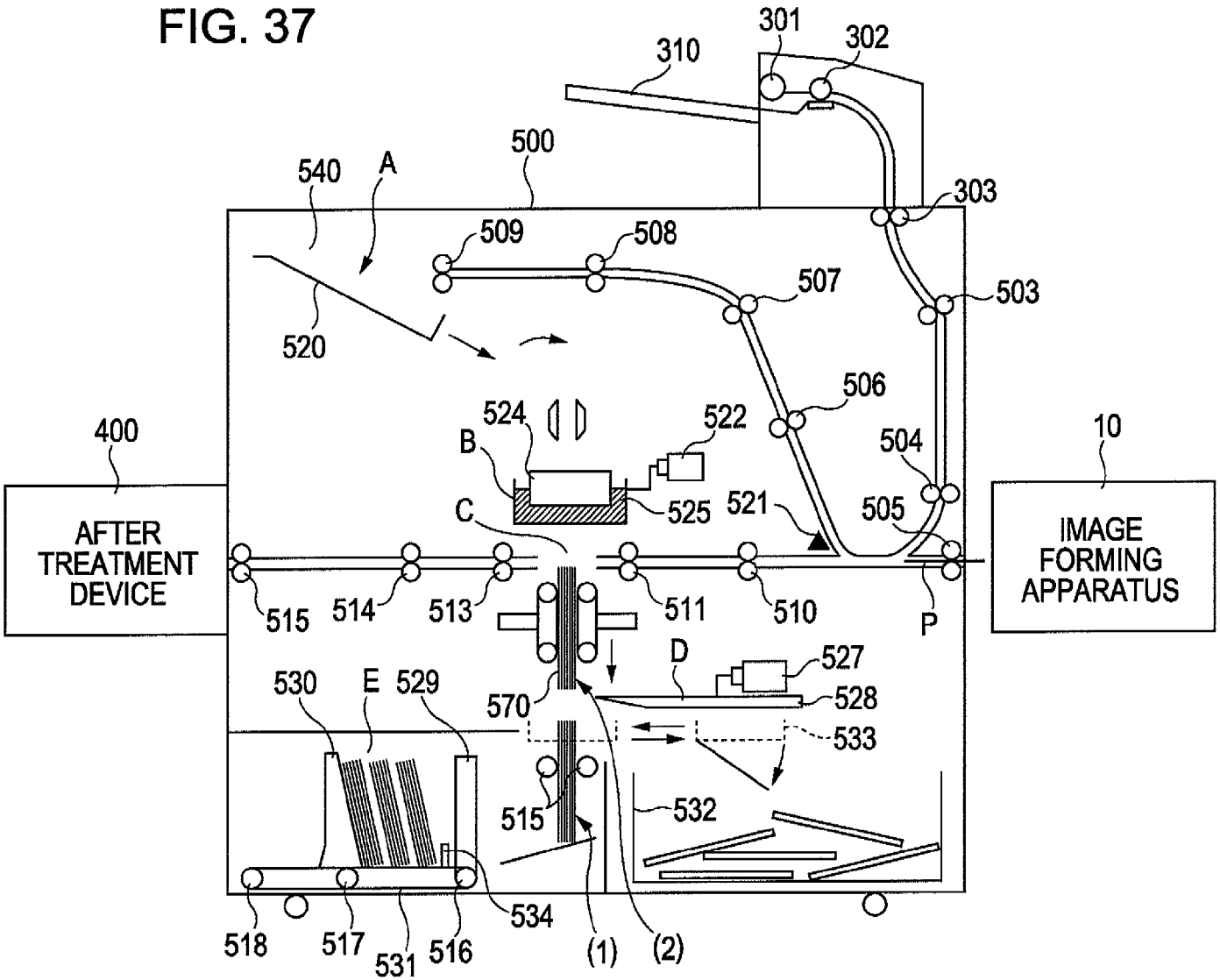
FIG. 37 is an arrangement drawing of two sheet bundles (1) and (2) in the device.
Figure 38:
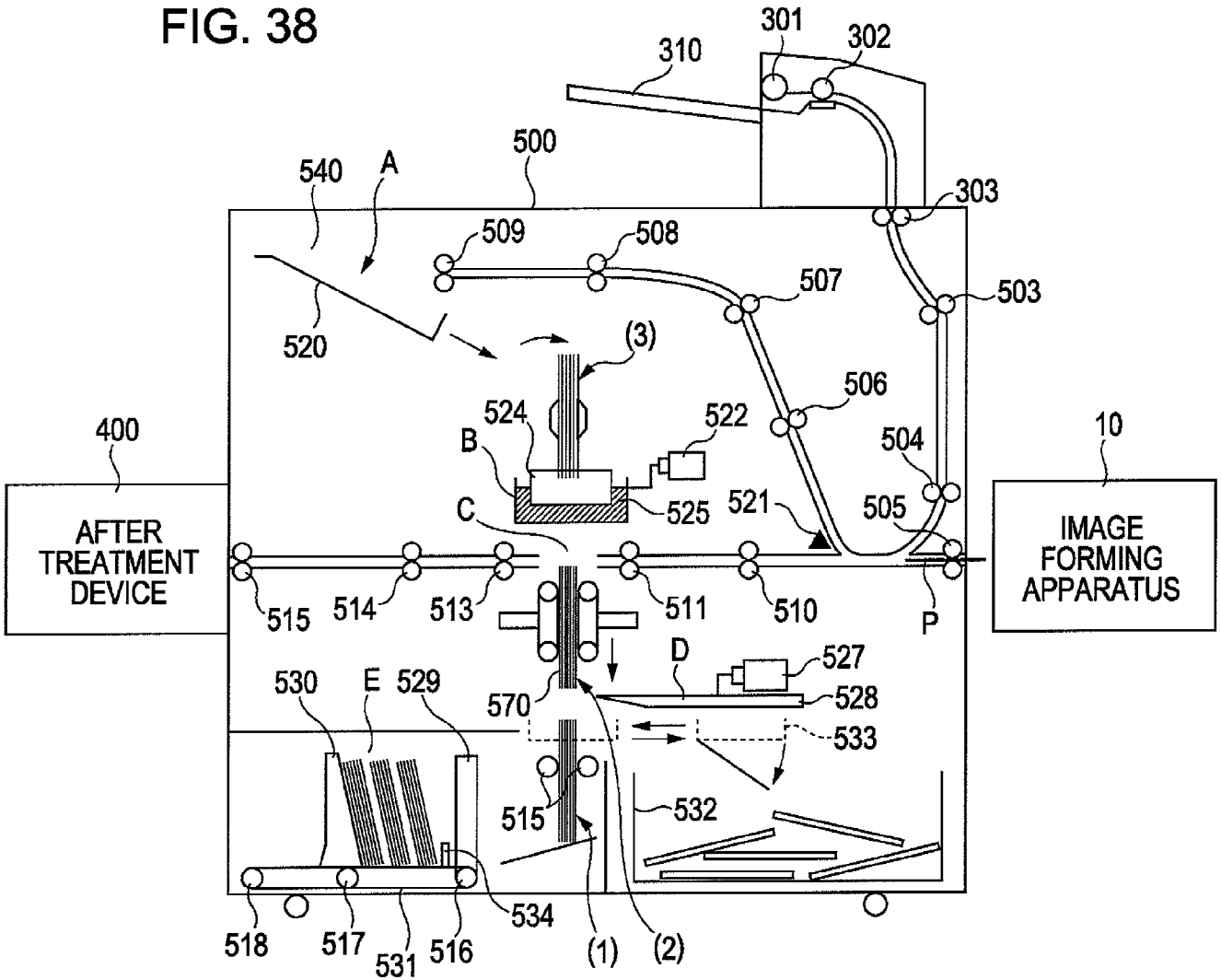
FIG. 38 is an arrangement drawing of three sheet bundles (1), (2), and (3) in the device.

The residing state of sheet bundles when a new job is entered to the bonding book binding apparatus 500 while the bound book discharge unit E being taken out will be described with reference to FIGS. 37 and 38. As shown in FIG. 37, when two volumes of sheet bundles are residing, the sheet bundle can be conveyed to a downstream device. As shown in FIG. 38, when three volumes of sheet bundles are residing, the sheet bundle cannot be conveyed to the downstream device. This is because the cover sheet resides in the conveying path to the downstream device. Even after conveying completion of the cover sheet, the conveying path from the gluing unit B toward the cutting unit D (book binding process conveying path) intersects with the sheet conveying path toward the downstream device (through conveying path), so that the sheet cannot be conveyed to the downstream device.

Then, the determining control of whether the sheet bundle can be conveyed to the downstream device from the bonding book binding apparatus 500 will be described with reference to the flowchart of FIG. 35. This flowchart is employed for the execution by the accessory control unit 214.

First, the accessory control unit 214 examines how many volumes of sheet bundles are stored within the bonding book binding apparatus 500 (Step 900). At this time, the accessory control unit 214 excludes bound bundles loaded on the bound book discharge unit E from the counting. Also, the accessory control unit 214 includes sheets loaded on the sheet loading unit A into the counting even it is one sheet.

Then, the accessory control unit 214 determines whether the counted value is 3 or more (Step 901). If it is 3 or more, the accessory control unit 214 stops conveying to the downstream device (Step 902). Thereby, the sheet bundle conveyed from the gluing unit B to the cutting unit D is prevented from colliding with the sheet conveyed from the image forming apparatus 10 toward the after treatment device 400 so as to generate the jamming. If the counted value is less than 3, the accessory control unit 214 permits the conveying to the downstream device (Step 903). That is, even when sheet bundles remain within the bonding book binding apparatus 500, if the counted value is less than 3, the job conveying the sheet bundle to the downstream device is enabled, improving the productivity.

Then, the accessory control unit 214 determines whether the counted value is 4 or more (Step 904). If it is 4 or more, the accessory control unit 214 stops discharging onto the sheet loading tray 520 in the bonding book binding apparatus 500 (Step 906). If the counted value is less than 4, the accessory control unit 214 permits discharging the sheet onto the sheet loading tray 520 in the bonding book binding apparatus 500 (Step 905).

The accessory control unit 214 of the bonding book binding apparatus 500 informs the image forming apparatus 10 of the stopping and permitting operation information described with reference to the flowchart of FIG. 35.

Figure 36:
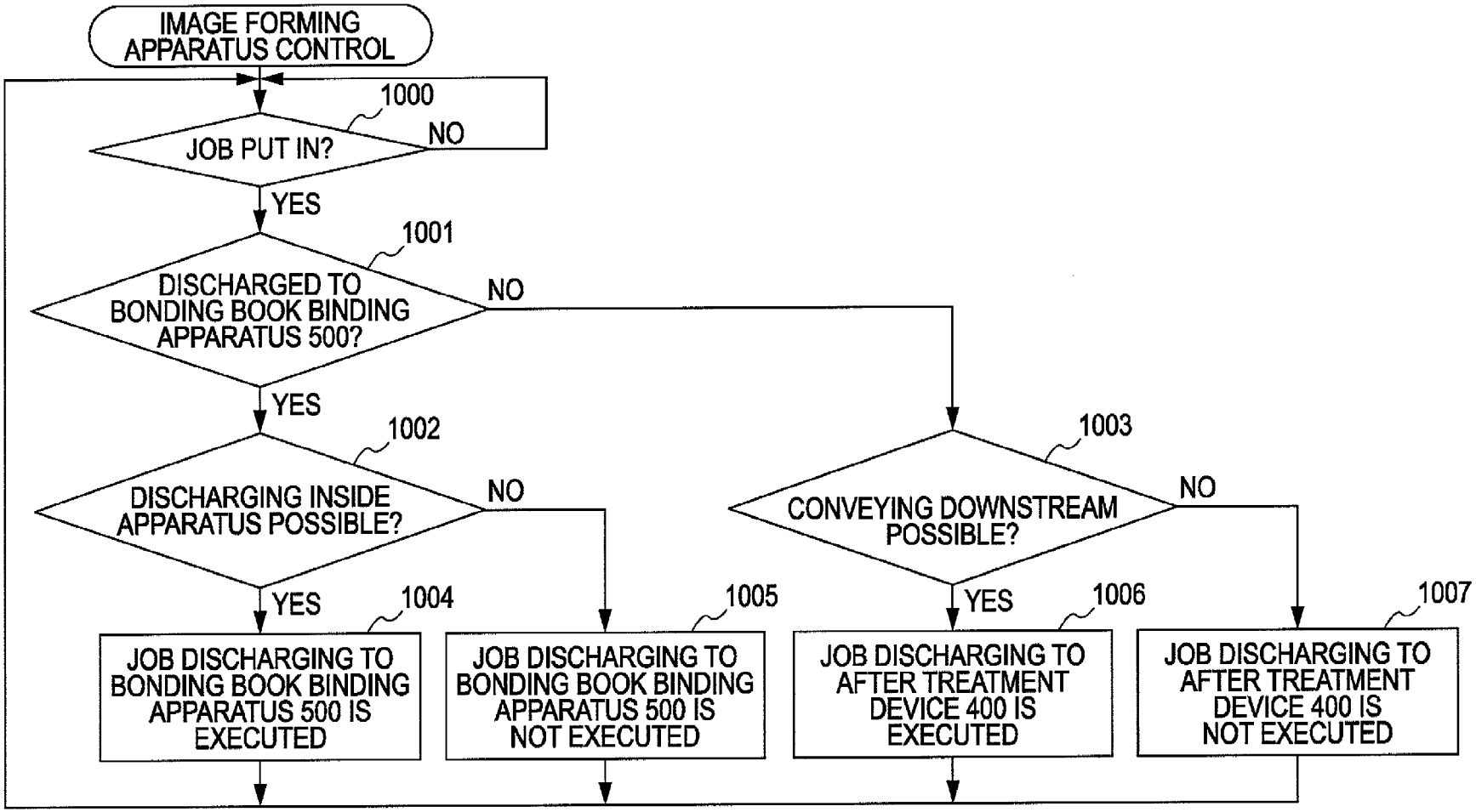
FIG. 36 is a flowchart illustrating job control of an image forming apparatus.

The image forming apparatus 10 controls the job on the basis of the information provided from the accessory control unit 214. An example of the job control will be described with reference to the flowchart of FIG. 36. This flowchart is employed for the execution by the job control unit 201 in the image forming apparatus 10.

First, the job control unit 201 waits for the print job coming from the external device 206 (Step 1000). Upon receiving the print job, the job control unit 201 determines whether the discharge destination of the print job is the bonding book binding apparatus 500 (Step 1001). If it is so, the job control unit 201 determines whether the bonding book binding apparatus 500 permits discharging to the sheet loading tray 520 (Step 1002). If it permits, the job control unit 201 executes the job (Step 1004). On the other hand, if it stops, the job control unit 201 stops executing the job (Step 1005). Although the job control unit 201 informs a user that the job cannot be executed and waits until the job can be executed at this time. However, the flowchart omits these controls.

If the discharge destination of the print job coming at Step 1001 is not the bonding book binding apparatus 500, the destination necessarily becomes the after treatment device 400. When a sheet is conveyed to the after treatment device 400, the bonding book binding apparatus 500 receives the sheet from the image forming apparatus 10 so as to transfer the sheet to the after treatment device 400. Then, the job control unit 201 determines whether the bonding book binding apparatus 500 permits conveying to the downstream device (the after treatment device 400) (Step 1003). If it permits, the job control unit 201 starts the job (Step 1006). If it stops, the job control unit 201 stops executing the job. Also, at Step 1007, in the same way as in the control at Step 1005, the job control unit 201 informs a user that the job cannot be executed and waits until the job can be executed.

As described above, according to the embodiment of the present invention, even in a compact book binding apparatus in that conveying paths intersect with each other, the productivity can be improved by preventing problems, such as sheet jamming.

Other Embodiments

Figure 39:
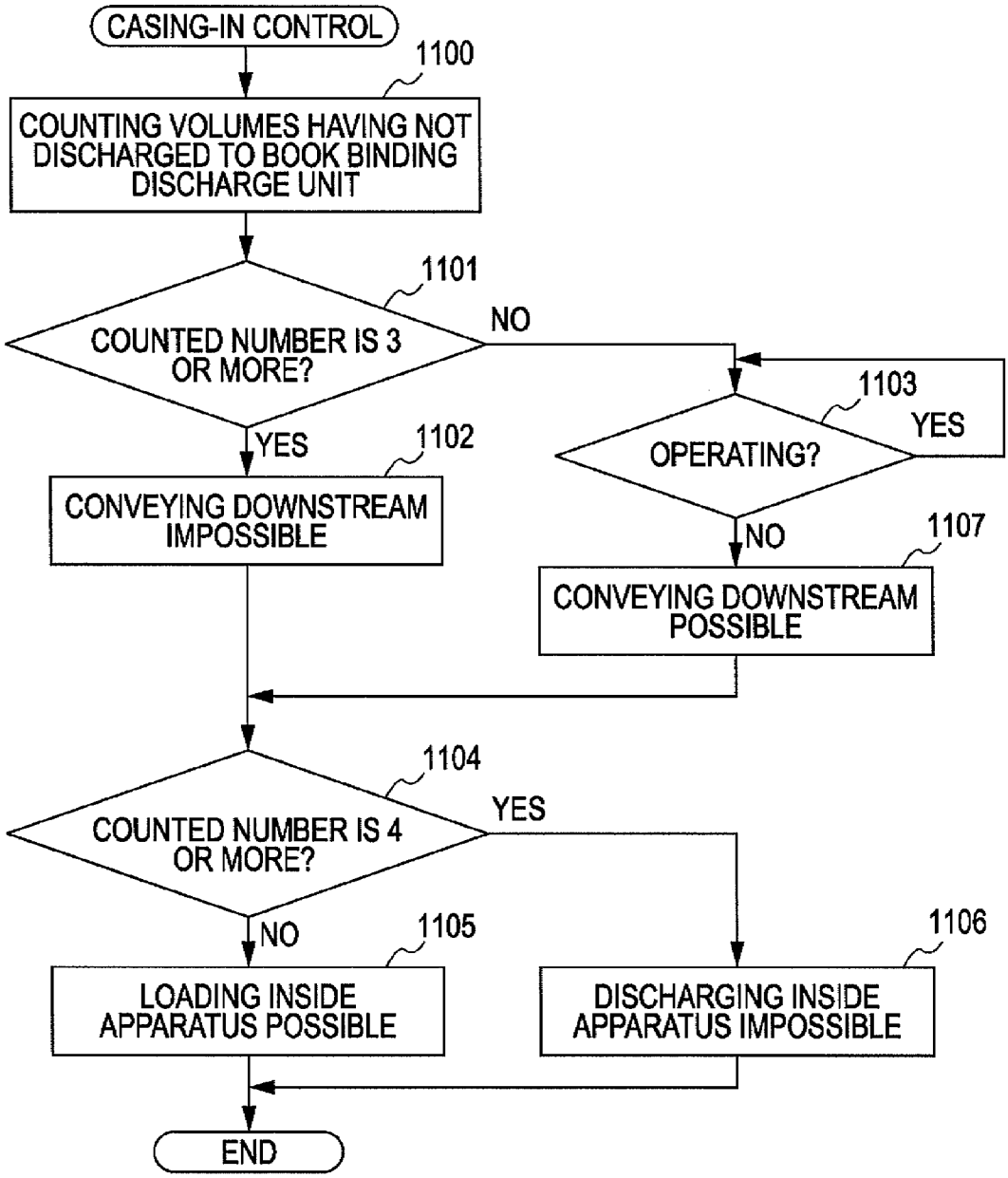
FIG. 39 is a flowchart illustrating conveying-operation allowing control of a bonding book binding apparatus according to another embodiment.

Another embodiment regarding the control that the bonding book binding apparatus 500 decides whether a bound sheet can be conveyed downstream will be described with reference to the flowchart of FIG. 39. This flowchart is employed for execution by the accessory control unit 214 in the bonding book binding apparatus 500.

Figure 35:
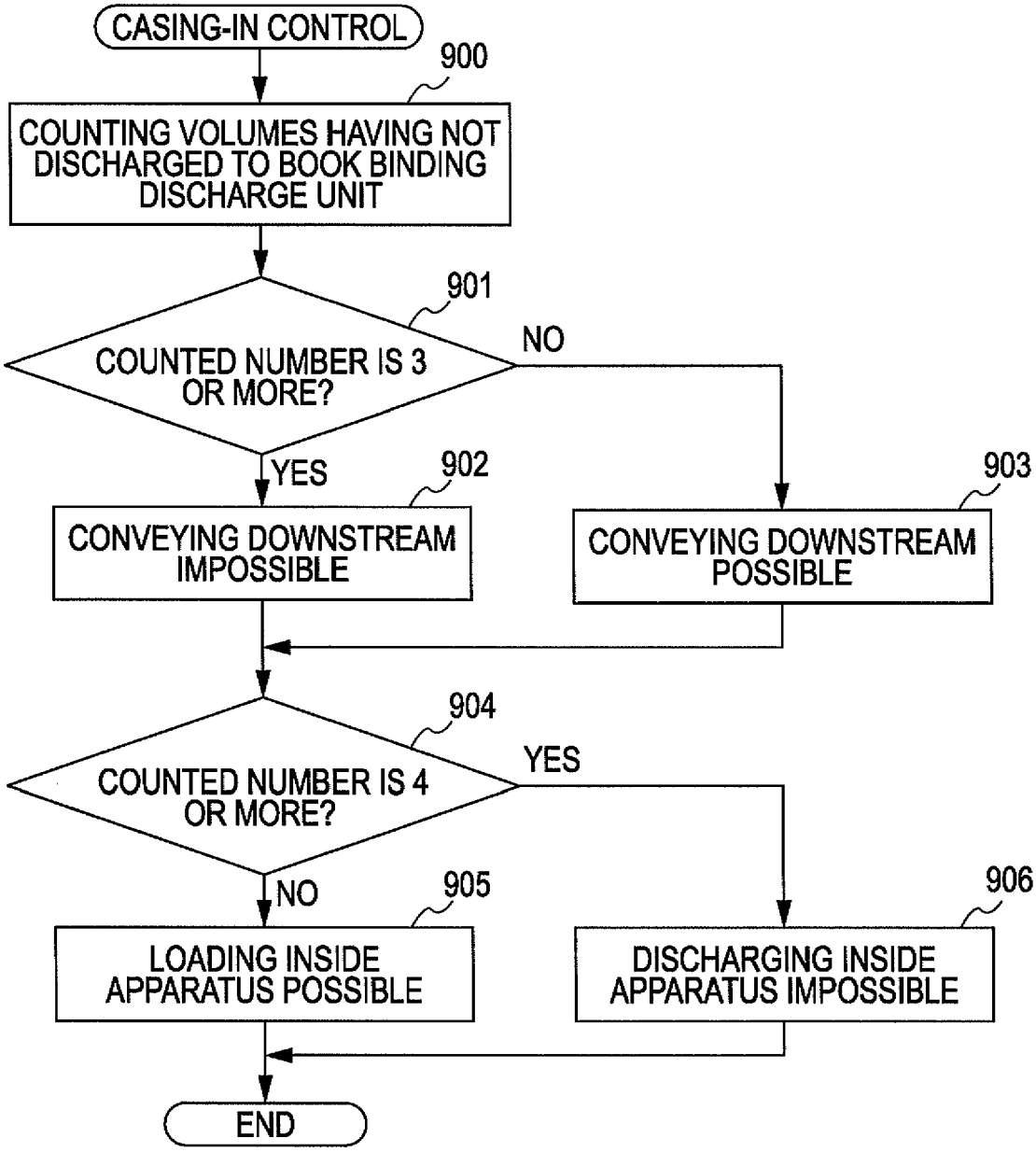
FIG. 35 is a flowchart illustrating conveying-operation allowing control of the bonding book binding apparatus.

First, the accessory control unit 214, in the same way as at Step 900 of FIG. 35, examines how many volumes of sheet bundles are stored within the bonding book binding apparatus 500 (Step 1100). At this time, the accessory control unit 214 excludes bound bundles loaded on the bound book discharge unit E from the counting. Also, the accessory control unit 214 includes sheets loaded on the sheet loading unit A into the counting even it is one sheet. Then, the accessory control unit 214 determines whether the counted value is 3 or more (Step 1101). If it is 3 or more, the accessory control unit 214 stops conveying to the downstream device (Step 1102). If the counted value is less than 3, the accessory control unit 214 further determines whether the bonding book binding apparatus 500 is operating or not, and when it is operating, even if the sheet bundle can be downstream conveyed, the downstream conveying is left stopped (Step 1103). When it is not operating, the accessory control unit 214 permits the conveying to the downstream device (Step 1107). Then, the accessory control unit 214 determines whether the counted value is 4 or more (Step 1104). If it is 4 or more, the accessory control unit 214 stops discharging the sheet onto the sheet loading tray 520 in the bonding book binding apparatus 500 (Step 1106). If the counted value is less than 4, the accessory control unit 214 permits the discharging sheet onto the sheet loading tray 520 in the bonding book binding apparatus 500 (Step 1105).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This invention can be applied to the sheet conveying apparatus in which the bookbinding function is not provided as well. That is, this invention can be applied to the sheet conveying apparatus which includes a first conveying path configured to receive a sheet from a device connected on the upstream side in a sheet conveying direction so as to transfer the sheet to a device connected on the downstream side in the sheet conveying direction, and a second conveying path which is intersecting with the first conveying path.

In the embodiment of the above mentioned, the job control unit 201 controls whether permitting or prohibiting a first operation mode in which the sheet being conveyed along the first conveying path in accordance with the state of the sheet on the second conveying path. However, irrespective of the state of the sheet on the second conveying path, the job control unit may control prohibiting a second operating mode (bookbinding mode) in which the sheet passes the second conveying path and permitting the first operation mode in which the sheet passes the first conveying path.

Moreover, the job control unit 201 may slow down the sheet transportation speed without prohibiting either mode of the first operating mode and the second operating mode, and operate the first operating mode and the second operating mode concurrently. That is, the job control unit 201 may slow down the sheet transportation speed of the first operating mode or the second operating mode so that the sheet being conveyed in the first conveying path and the sheet being conveyed in the second conveying path do not come into contact.

This application claims the benefit of Japanese Application No. 2006-094561 filed Mar. 30, 2006, which is hereby incorporated by reference herein in its entirety.

What is claimed is:

1. A book binding apparatus comprising:

a first conveying path configured to guide a sheet from a first device connected at an upstream side in a sheet conveying direction to a second device connected at the downstream side in the sheet conveying direction;

a loading tray configured to receive a plurality of sheets from the first device and to load the sheets thereon to form a sheet bundle;

a book binding device configured to convey the sheet bundle loaded on the loading tray and to bind the conveyed sheet bundle;

a discharging device configured to discharge the sheet bundle bound by the book binding device therein;

a storing device configured to store the sheet bundle discharged by the discharging device;

a second conveying path configured to facilitate conveying the sheet bundle from the loading tray to the storing device, the second conveying path intersecting with the first conveying path; and a controller configured to switch between a first operation mode in which the sheet is conveyed along the first conveying path so as to transfer the sheet to the second device, and a second operation mode in which the sheet bundle is conveyed along the second conveying path so as to execute binding on the sheet bundle using the book binding device, wherein the controller permits a sheet conveying operation in the first operation mode when the number of sheet bundles that have not been discharged to the storing device by the discharging device is smaller than a predetermined number, whereas the controller prohibits the sheet conveying operation in the first operation mode when the number of sheet bundles that have not been discharged to the storing device by the discharging device is equal to or larger than the predetermined number.

2. The apparatus according to claim 1, wherein the controller permits the discharging device to discharge sheet bundles to the storing device when the number of sheet bundles that have not been discharged is smaller than a second predetermined number that is larger than the predetermined number, whereas the controller prohibits the discharging device from discharging sheet bundles to the storing device when the number of sheet bundles that have not been discharged is equal to or larger than the second predetermined number.

3. The apparatus according to claim 1, wherein the book binding device binds a booklet by gluing a sheet bundle.

4. The apparatus according to claim 1, further comprising a cutting device configured to uniformly cut an end portion of the sheet bundle bound by the book binding device.

5. The apparatus according to claim 4, wherein the book binding device is arranged at a position above a confluent point of the first conveying path with the second conveying path, and the cutting device is arranged at a position below the confluent point.

6. The apparatus according to claim 1, further comprising a cover sheet feeding device configured to feed a cover sheet, wherein the cover sheet fed from the cover sheet feeding device is conveyed along the first conveying path.

7. The apparatus according to claim 1, wherein the book binding device is connected to an image forming apparatus arranged at the upstream side in the sheet conveying direction, and the controller informs the image forming apparatus about the determination of whether to permit or prohibit operation in the first operation mode or the second operation mode.

* * * * *